US011211008B2

(12) United States Patent
Park et al.

(10) Patent No.: US 11,211,008 B2
(45) **Date of Patent: *Dec. 28, 2021**

(54) DISPLAY DEVICE AND DRIVING METHOD THEREOF

(71) Applicant: SAMSUNG DISPLAY CO., LTD., Yongin-si (KR)

(72) Inventors: Jong Woong Park, Yongin-si (KR); Ho Suk Maeng, Yongin-si (KR); Weon Jun Choe, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/849,325

(22) Filed: Apr. 15, 2020

(65) Prior Publication Data

US 2020/0243016 A1 Jul. 30, 2020

Related U.S. Application Data

(63) Continuation of application No. 15/791,866, filed on Oct. 24, 2017, now Pat. No. 10,665,168.

(30) Foreign Application Priority Data

Dec. 21, 2016 (KR) ..... 10-2016-0175790

(51) Int. Cl.
*G09G 3/3258* (2016.01)
*G09G 3/20* (2006.01)
(Continued)

(52) U.S. Cl.
CPC ..... *G09G 3/3258* (2013.01); *G09G 3/2007* (2013.01); *G09G 3/3233* (2013.01);
(Continued)

(58) Field of Classification Search
CPC .. G09G 3/3258; G09G 3/2007; G09G 3/3266; G09G 3/3275; G09G 2320/0646;
(Continued)

(56) References Cited

U.S. PATENT DOCUMENTS 6,747,671 B1 6/2004 Saito
7,675,492 B2 3/2010 Park et al.
(Continued)

FOREIGN PATENT DOCUMENTS

CN 105679234 A 6/2016
EP 1855468 A2 11/2007
(Continued)

OTHER PUBLICATIONS

Extended European Search Report for Application No. 17209862.6 dated Apr. 17, 2018, citing the above reference(s).
(Continued)

*Primary Examiner* — Md Saiful A Siddiqui
(74) *Attorney, Agent, or Firm* — Cantor Colburn LLP

(57) ABSTRACT

A display device driven in one of a first mode and a second mode includes a first pixel area which includes first pixels, a second pixel area which includes the second pixels, a first boundary area which is included in the second pixel area and to be positioned between boundary portions of the first pixel area and the second pixel area, and a luminance controller which controls first boundary data corresponding to the first boundary area so that luminance of the first boundary area is gradually changed corresponding to a first data signal applied to the first pixels and the second pixels when the display device is driven in the second mode.

12 Claims, 15 Drawing Sheets

(51) Int. Cl.
*G09G 3/3266* (2016.01)
*G09G 3/3275* (2016.01)
*G09G 3/3233* (2016.01)

(52) U.S. Cl.
CPC ..... *G09G 3/3266* (2013.01); *G09G 3/3275* (2013.01); *G09G 2300/0426* (2013.01); *G09G 2300/0819* (2013.01); *G09G 2300/0842* (2013.01); *G09G 2300/0861* (2013.01); *G09G 2310/0221* (2013.01); *G09G 2310/04* (2013.01); *G09G 2310/08* (2013.01); *G09G 2320/045* (2013.01); *G09G 2320/0646* (2013.01); *G09G 2320/0686* (2013.01)

(58) Field of Classification Search
CPC ..... G09G 2300/0426; G09G 2310/08; G09G 3/3233; G09G 2300/0819; G09G 2300/0842; G09G 2300/0861; G09G 2310/0221; G09G 2320/0686
See application file for complete search history.

(56) References Cited

U.S. PATENT DOCUMENTS

| | | | | |
|---|---|---|---|---|
| 9,645,395 | B2 | 5/2017 | Bolas et al. | |
| 10,591,729 | B2 | 3/2020 | Watanabe et al. | |
| 2007/0229664 | A1 | 10/2007 | Nagaoka | |
| 2008/0111833 | A1 | 5/2008 | Thorn et al. | |
| 2010/0079356 | A1 | 4/2010 | Hoellwarth | |
| 2010/0245397 | A1* | 9/2010 | Choe | G09G 3/342 345/690 |
| 2012/0212517 | A1 | 8/2012 | Ahn | |
| 2013/0093802 | A1* | 4/2013 | Tanaka | G09G 3/003 345/690 |
| 2015/0103108 | A1 | 4/2015 | Seong et al. | |
| 2015/0116384 | A1 | 4/2015 | Kim et al. | |
| 2015/0170607 | A1 | 6/2015 | Shin | |
| 2015/0379952 | A1 | 12/2015 | Lee | |
| 2016/0357250 | A1 | 12/2016 | Kim et al. | |
| 2017/0316607 | A1* | 11/2017 | Khalid | G02B 27/0172 |
| 2018/0075808 | A1* | 3/2018 | Yamashita | G09G 3/3266 |

FOREIGN PATENT DOCUMENTS

| | | | |
|---|---|---|---|
| KR | 1020150069850 | A | 6/2015 |
| WO | 2016194844 | A1 | 12/2016 |

OTHER PUBLICATIONS

Taiwanese Office Action for Application No. 106144593 dated Jul. 29, 2021, citing the above reference(s).

* cited by examiner

DISPLAY DEVICE AND DRIVING METHOD THEREOF

This application is a continuation of U.S. application Ser. No. 15/791,866, filed on Oct. 24, 2017, which claims priority to Korean Patent Application No. 10-2016-0175790 filed on Dec. 21, 2016, and all the benefits accruing therefrom under 35 U.S.C. § 119, the content of which in its entirety is herein incorporated by reference.

BACKGROUND

(a) Field

Exemplary embodiments of the invention relate to a display device and a driving method thereof, and more particularly, to a display device and a driving method thereof that may improve display quality.

(b) Description of the Related Art

Recently, various electronic devices that may be directly worn on a body are developed. Such electronic devices are referred to as wearable devices.

Particularly, as an example of the wearable devices, a head mounted display device ("HMD") displays a realistic image and provides high immersion to a viewer, thus the HMD is used in various fields such as viewing movies.

SUMMARY

Exemplary embodiments of the invention have been made in an effort to provide a display device and a driving method thereof that may improve display quality.

An exemplary embodiment of the invention provides a display device driven in one of a first mode and a second mode, the display device including a first pixel area which includes first pixels, a second pixel area which includes the second pixels, a first boundary area which is included in the second pixel area and positioned between boundary portions of the first pixel area and the second pixel area, and a luminance controller which controls first boundary data corresponding to the first boundary area so that luminance of the first boundary area is gradually changed when the display device is driven in the second mode.

In an exemplary embodiment, when the display device is disposed on a wearable device, the display device may be set to be driven in the second mode, and otherwise, the display device may be set to be driven in the first mode.

In an exemplary embodiment, when all of horizontal lines included in the first pixel area and the second pixel area are set as about 100%, the first boundary area may be set to include horizontal lines of about 1% or more.

In an exemplary embodiment, the luminance controller may control the first boundary data so that the luminance thereof gradually increases as farther from the boundary portions of the first pixel area and the second pixel area.

In an exemplary embodiment, when the display device is driven in the first mode, the first pixels and the second pixels may be driven corresponding to a first data signal.

In an exemplary embodiment, when the display device is driven in the first mode, the luminance controller may not change a bit of the first boundary data.

In an exemplary embodiment, when the display device is driven in the second mode, the first pixels may be set to be in a non-emissive state, and the second pixels may be driven corresponding to a second data signal.

In an exemplary embodiment, when the display device is driven in the second mode, the luminance controller may control the luminance of the first boundary area through Equation 1:

$$\text{Data}\mathbf{2}=\text{Data}\mathbf{1}(AB\mathbf{1})\times\alpha \qquad \text{Equation 1}$$

where, in Equation 1, Data1(AB1) denotes first boundary data inputted to the luminance controller, Data2 denotes first data generated in the luminance controller, and a denotes a luminance weight value.

In an exemplary embodiment, the luminance weight value is set to be in a range of about 0% to about 100%.

In an exemplary embodiment, the luminance weight value may be set so that luminance thereof gradually increases as farther from the boundary portions of the first pixel area and the second pixel area.

In an exemplary embodiment, the display device may further include a timing controller which supplies the first boundary data among first data supplied from an outside to the luminance controller.

In an exemplary embodiment, the luminance controller may be included in the timing controller.

In an exemplary embodiment, the display device may further include a data driver which generates a data signal to be supplied to data lines connected to the first pixels and the second pixels using the first data and the first boundary data.

In an exemplary embodiment, the display device may further include a first scan driver which drives first scan lines connected to the first pixels, a first emission driver which drives first light emitting control lines connected to the first pixels, a second scan driver which drives second scan lines connected to the second pixels, and a second emission driver which drives second light emitting control lines connected to the second pixels.

In an exemplary embodiment, when the display device is driven in the first mode, the first scan driver may supply a scan signal to the first scan lines, and the first emission driver may supply a light emitting control signal to the first light emitting control lines so that the first pixel emits light corresponding to a first data signal.

In an exemplary embodiment, when the display device is driven in the second mode, the first emission driver may supply a gate-off voltage to the first light emitting control lines.

In an exemplary embodiment, when the display device is driven in the first mode or the second mode, the second scan driver may supply a scan signal to the second scan lines, and the second emission driver may supply a light emitting control signal to the second light emitting control lines so that the second pixel emits light corresponding to a first data signal in the first mode or a second data signal in the second mode.

In an exemplary embodiment, the display device may further include a third pixel area which includes third pixels, and a second boundary area which is included in the second pixel area and to be positioned between boundary portions of the second pixel area and the third pixel area.

In an exemplary embodiment, when all of horizontal lines included in the first pixel area, the second pixel area, and the third pixel area are set as about 100%, each of the first boundary area and the second boundary area may be set to include horizontal lines of about 1% or more.

In an exemplary embodiment, when the display device is driven in the second mode, the luminance controller may control second boundary data corresponding to the second boundary area so that luminance thereof gradually increases as farther from boundary portions of the second pixel area and the third pixel area corresponding to the first data signal.

In an exemplary embodiment, when the display device is driven in the first mode, the luminance controller may not change a bit of the second boundary data.

In an exemplary embodiment, when the display device is driven in the second mode, the luminance controller may control the luminance of the second boundary area through Equation 2:

$$\text{Data}2=\text{Data}1(AB2)\times\alpha \qquad \text{Equation 2}$$

where, in Equation 2, Data1(AB2) denotes the second boundary data inputted to the luminance controller, Data2 denotes second data generated in the luminance controller, and a denotes a luminance weight value.

In an exemplary embodiment, the luminance weight value may be set to be in a range of about 0% to about 100%.

In an exemplary embodiment, the luminance weight value may be set so that luminance thereof gradually increases as farther from the boundary portions of the second pixel area and the third pixel area.

In an exemplary embodiment, the display device may further include a first scan driver which drives first scan lines connected to the first pixels, a first emission driver which drives first light emitting control lines connected to the first pixels, a second scan driver which drives second scan lines connected to the second pixels, a second emission driver which drives second light emitting control lines connected to the second pixels, a third scan driver which drives third scan lines connected to the third pixels, and a third emission driver which drives third light emitting control lines connected to the third pixels.

In an exemplary embodiment, when the display device is driven in the first mode, the first scan driver may supply a scan signal to the first scan lines, and the third scan driver may supply a scan signal to the third scan lines, and the first emission driver may supply a light emitting control signal to the first light emitting control lines so that the first pixel emits light corresponding to a first data signal, and the third emission driver may supply a light emitting control signal to the third light emitting control lines so that the third pixel emits light corresponding to the first data signal.

In an exemplary embodiment, when the display device is driven in the second mode, the first emission driver may supply a gate-off voltage to the first light emitting control lines, and the third emission driver may supply a gate-off voltage to the third light emitting control lines.

In an exemplary embodiment, when the display device is driven in the first mode or the second mode, the second scan driver may supply a scan signal to the second scan lines, and the second emission driver may supply a signal light emitting control signal to the second light emitting control lines so that the second pixel emits light corresponding to a first data signal in the first mode or a second data signal in the second mode.

In an exemplary embodiment, when the display device is driven in the second mode, the luminance controller may control the luminance of the first boundary area and the second boundary area through Equation 3.

$$\text{Data}2=\text{Data}1(AB1 \text{ or } AB2)\times\alpha+\beta \qquad \text{Equation 3}$$

where, in Equation 3, Data1(AB1) denotes the first boundary data inputted to the luminance controller, Data1 (AB2) denotes the second boundary data inputted to the luminance controller, Data2 denotes first data or second data generated in the luminance controller, α denotes a luminance weight value, and β denotes an initial gray level.

In an exemplary embodiment, the initial gray level β may be set as one of gray levels excluding a black gray.

Another embodiment of the invention provides a driving method of a display device which includes a first pixel area including first pixels and a second pixel area including second pixels, including displaying an image corresponding to a first data signal in the first pixel area and the second pixel area when the display device is driven in a first mode, and displaying an image corresponding to a second data signal in the second pixel area when the display device is driven in a second mode, where when the display device is driven in the second mode, luminance of a boundary area positioned between boundary portions of the first pixel area and the second pixel area may be gradually changed corresponding to the second data signal.

In an exemplary embodiment, when the display device is disposed on a wearable device, the display device may be set to be driven in the second mode, and otherwise, the display device may be set to be driven in the first mode.

In an exemplary embodiment, when all of horizontal lines included in the first pixel area and the second pixel area are set as about 100%, the boundary area may be set to include horizontal lines of about 1% or more.

In an exemplary embodiment, the luminance of the boundary area may gradually increases as farther from the boundary portions of the first pixel area and the second pixel area.

In an exemplary embodiment, the boundary area may be included in the second pixel area.

In an exemplary embodiment, when the display device is driven in the second mode, the first pixels may be set to be in a non-emissive state.

According to the display device and the driving method thereof of the embodiment of the invention, when the display device is installed at the wearable device, the display device is divided into the first area set to be in a non-emissive state and the second area set to be in an emissive state. In the embodiment of the invention, it is possible to prevent the boundary portions of the first area and second area from being recognized to a user by changing the luminance of the boundary portions of the first area and second area in a gradation way.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1A:
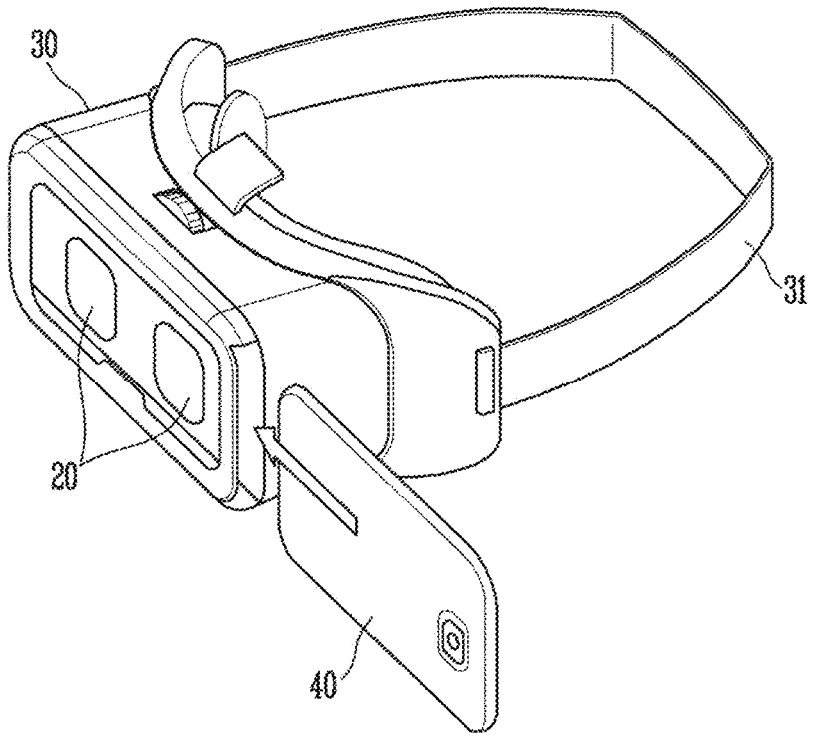
FIGS. 1A and 1B illustrate schematic views of an exemplary embodiment of a wearable device according to the invention.

The disclosure may be understood more readily by reference to the following detailed description of embodiments and accompanying drawings. However, the disclosure may be embodied in many different forms, and should not be construed as being limited to the embodiments set forth herein. Rather, these embodiments are provided so that this disclosure will be through and complete and will fully convey the concept of the invention to those skilled in the art, and the disclosure will only be defined by the appended claims.

Throughout this specification and the claims that follow, when it is described that an element is "connected" to another element, the element may be "directly connected" to the other element or "indirectly connected" to the other element through a third element. Further, in exemplary embodiments, for components having the same configuration, like reference numerals are used and described only in a representative embodiment.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 1B:
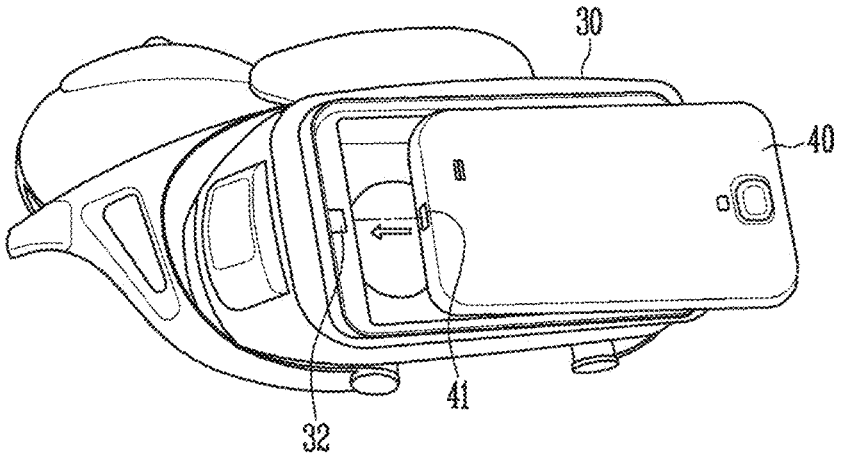

FIGS. 1A and 1B illustrate schematic views of a wearable device according to an exemplary embodiment of the invention. FIGS. 1A and 1B respectively illustrate a head mounted display device ("HMD") as an example of a wearable device.

Referring to FIGS. 1A and 1B, an HMD according to an exemplary embodiment of the invention includes a body part 30.

The body part 30 includes a band 31. The body part 30 may be worn on a user's head using the band 31. As such, the body part 30 has a structure that allows a display device 40 to be detachably mounted.

In an exemplary embodiment, the display device 40 that may be mounted on the HMD may be, for example, a smartphone. However, in the exemplary embodiment, the display device 40 is not limited to the smartphone. In an exemplary embodiment, the display device 40 may be one of electronic devices such as a tablet personal computer ("PC"), an electronic book reader, a personal digital assistant ("PDA"), a portable multimedia player ("PMP"), a camera, and the like, which include a display part.

When the display device 40 is mounted on the body part 30, a connecting part 41 of the display device 40 and a connecting part 32 of the body part 30 are electrically connected, thus the body part 30 may be communicated with the display device 40. In an exemplary embodiment, the HMD may include one of a touch panel, a button, and a wheel key for controlling the display device 40, for example, which are not illustrated.

When the display device 40 is mounted on the HMD, the display device 40 may be driven in a second mode, and when the display device 40 is detached from the HMD, the display device 40 may be driven in a first mode. When the display device 40 is mounted on the HMD, a driving mode of the display device 40 may be automatically switched to the second mode, or the driving mode may be switched to the second mode by the user.

In addition, when the display device 40 is detached from the HMD, the driving mode of the display device 40 may be automatically switched to the first mode, or the driving mode may be switched to the first mode by a user.

The HMD includes lenses 20 respectively corresponding to the two eyes of the user. In an exemplary embodiment, the lenses 20 may include fisheye lenses, wide-angle lenses, or the like, for example, for improving a field of view ("FOV") of the user.

When the display device 40 is fixed to the body part 30, the user views the display device 40 through the lenses 20, thus the user may enjoy the same effect as viewing an image by placing a large screen at a predetermined distance.

In this case, since the user views the display device 40 through the lenses 20, an effective display area of the display device 40 is divided into a high visibility area and a low visibility area. In an exemplary embodiment, a central area with respect to both eyes of the user has high visibility and the other areas have low visibility, for example.

When the display device 40 is driven in the second mode in order to be able to display a more vivid image to the user, the image is displayed on only a portion of the effective display area. When the image is displayed on only a portion of the effective display area, it is possible to increase a driving frequency, thus a vivid image may be displayed on the display device 40. A gate-off voltage is supplied to signal lines (e.g., scanning lines, light emitting control lines, etc.) positioned at the other areas excluding the effective display area, thus pixels disposed in the other areas are not light-emitted.

Figure 2:
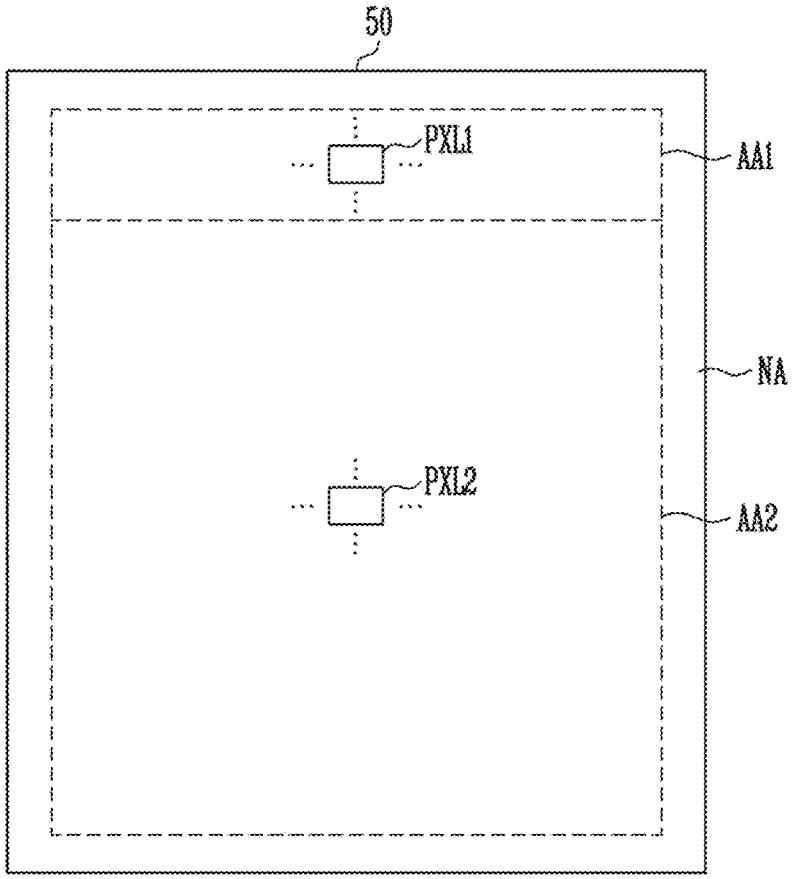
FIG. 2 illustrates an exemplary embodiment of a pixel area of a display device according to the invention.

FIG. 2 illustrates a pixel area of a display device according to an exemplary embodiment of the invention.

Referring to FIG. 2, a display device according to an exemplary embodiment of the invention includes pixel areas AA1 and AA2 and a peripheral area NA. In this case, the pixel areas AA1 and AA2 and the peripheral area NA may be provided on a substrate 50.

A plurality of pixels PXL1 and PXL2 is respectively positioned in the pixel areas AA1 and AA2, thus a predetermined image is displayed in the pixel areas AA1 and AA2. Accordingly, the pixel areas AA1 and AA2 may be set as the effective display area.

In FIG. 2, it is illustrated that widths of a first pixel area AA1 and a second pixel area AA2 are the same, but the invention is not limited thereto. In an exemplary embodiment, the first pixel area AA1 may be narrower as farther from the second pixel area AA2, for example.

In addition, the first pixel area AA1 may be narrower than the second pixel area AA2. In this case, the number of first pixels PXL1 disposed on a horizontal line of the first pixel area AA1 may be greater than that of the second pixels PXL2 disposed on a horizontal line of the second pixel area AA2.

The substrate 50 may have various shapes so that the pixel areas AA1 and AA2 may be provided therein. In an exemplary embodiment, the substrate 50 may include an insulating material such as glass, resin, or the like, for example. In an exemplary embodiment, the substrate 50 may include a flexible or foldable material, and have a single-layered or multiple-layered structure.

Constituent elements (e.g., drivers and wires) for driving the pixels PXL1 and PXL2 are disposed in the peripheral area NA. The pixels PXL1 and PXL2 are not provided in the peripheral area NA, thus the peripheral area NA may be provided as a non-display area. The peripheral area NA is provided around the pixel areas AA1 and AA2, and may have a shape surrounding at least a portion of the pixel areas AA1 and AA2.

The pixel areas include the first pixel area AA1 and the second pixel area AA2.

The second pixel area AA2 may be larger than the first pixel area AA1. The second pixel area AA2 includes the second pixels PXL2. The second pixels PXL2 generate light of predetermined luminance corresponding to a data signal.

The first pixel area AA1 is positioned at one side of the second pixel area AA2, and may be smaller than the second pixel area AA2. The first pixel area AA1 includes the first pixels PXL1. The first pixels PXL1 generate light of predetermined luminance corresponding to a data signal.

Each of the first pixels PXL1 and the second pixels PXL2 includes a driving transistor and an organic light emitting diode. The driving transistor controls a current amount supplied to the organic light emitting diode corresponding to a data signal.

Figure 3:
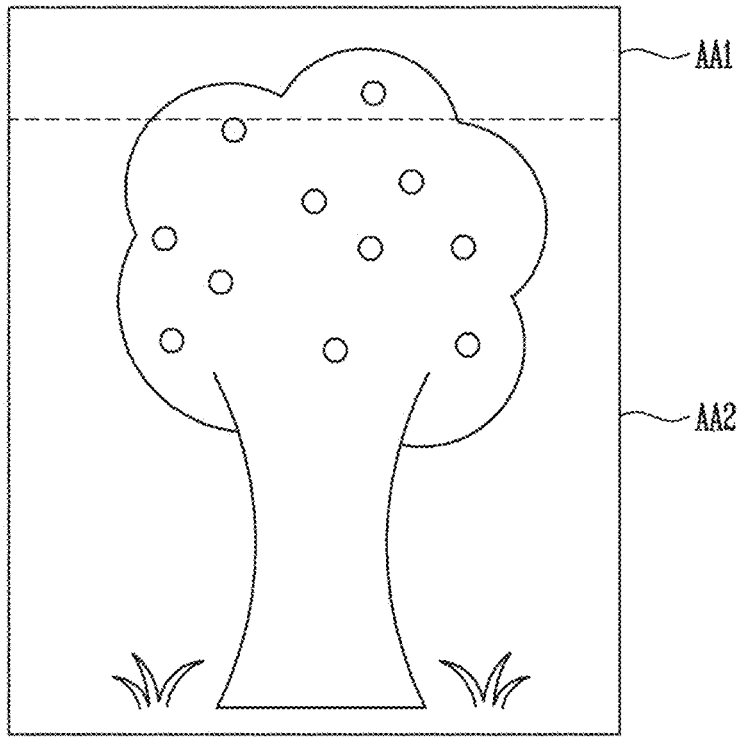
FIGS. 3 and 4 illustrate examples of an image displayed in the pixel area illustrated in FIG. 2 corresponding to a mode.

When the display device is driven in the first mode, as shown in FIG. 3, a predetermined image is displayed in the first pixel area AA1 and the second pixel area AA2.

Figure 4:
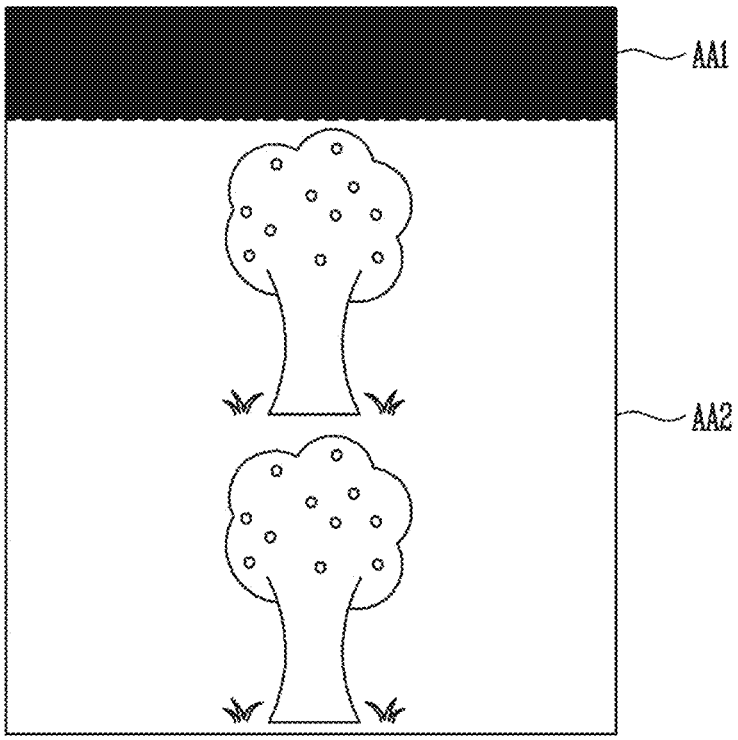

When a display device is driven in the second mode, as shown in FIG. 4, a predetermined image is displayed in the second pixel area AA2. In this case, the image displayed in the second pixel area AA2 may be two identical or different images corresponding to the two eyes of the user. In fact, the image displayed in the second pixel area AA2 may be various images corresponding to the characteristics and the like of HMD.

When the display device is driven in the second mode, the first pixels PXL1 included in the first pixel area AA1 are in a non-emissive state. In an exemplary embodiment, when the display device is driven in the second mode, a black screen may be displayed in the first pixel area AA1, for example.

When the display device is driven in the second mode, the first pixels PXL1 are in a non-emissive state, and the second pixels PXL2 are in an emissive state corresponding to a data signal. In this case, since the characteristics of the driving transistors respectively included the first pixels PXL1 and the second pixels PXL2 may be different, a luminance difference may be recognized at boundary portions of the first pixels PXL1 and the second pixels PXL2.

Figure 5:
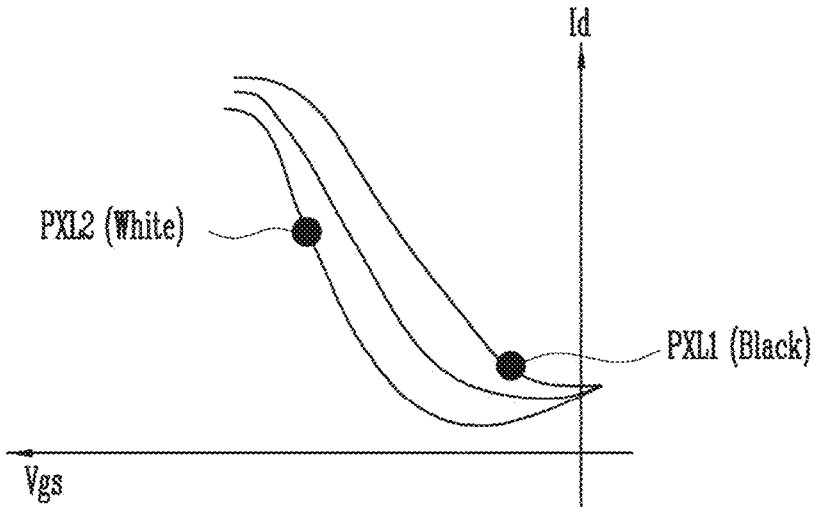
FIGS. 5 and 6 illustrate examples of characteristic deviation of a driving transistor when a display device is driven in a second mode.

FIG. 5 illustrates an example of characteristic deviation of the driving transistor when the display device is driven in the second mode. FIG. 5 illustrates a case in which the driving transistor is a P-type transistor, e.g., P-type metal-oxide-semiconductor field-effect transistor ("PMOS"). For better understanding and ease of description, a driving transistor included in the first pixel PXL1 is referred to as a first driving transistor, and a driving transistor included in the second pixel PXL2 is referred to as a second driving transistor.

Referring to FIG. 5, when the display device is driven in the second mode, the first pixels PXL1 are in a non-emissive, thus a black screen may be displayed in the first pixel area AA1.

In an exemplary embodiment, when the display device is driven in the second mode, the first pixels PXL1 may receive a black data signal, for example. Then, a voltage Vgs corresponding to a black data signal is applied to the first driving transistor included in each of the first pixels PXL1. That is, when the black data signal is received, the voltage Vgs may be applied to the first driving transistor so that the first driving transistor is turned off.

When the display device is driven in the second mode, the second pixels PXL2 may receive a predetermined data signal, for example, a white data signal. Then, the voltage Vgs corresponding to the white data signal is applied to the second driving transistor included in each of the second pixels PXL2. That is, when the white data signal is received, the voltage Vgs may be applied to the second driving transistor included in each of the second pixels PXL2 so that the second driving transistor is fully turned on.

A user can drive the display device in the second mode during a predetermined period. In this case, the characteristics of the first driving transistor and the second driving transistor may be different from each other according to a difference between the voltage Vgs of the first driving transistor and the voltage Vgs of the second driving transistor, which results in a difference between the current Id of the first driving transistor and the current Id of the second driving transistor.

Figure 6:
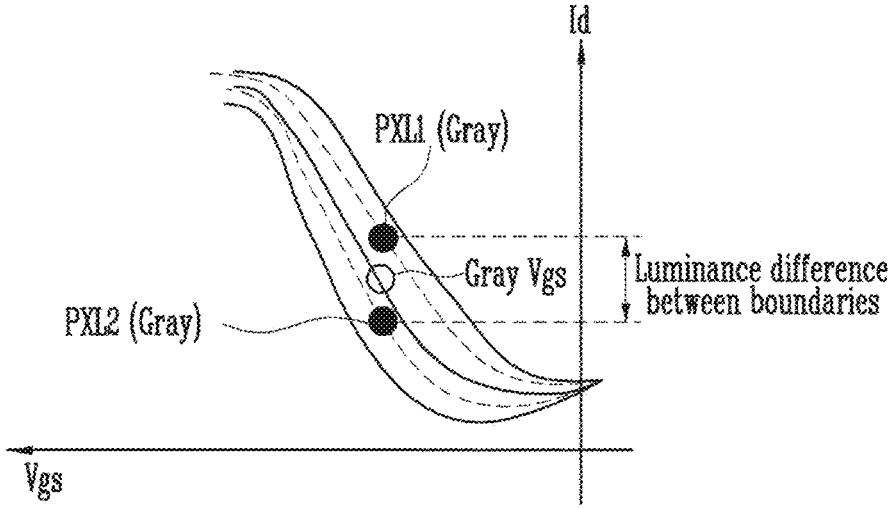

In this case, when the display device is driven in the first mode, even when the same data signal is supplied to the first pixels PXL1 and the second pixels PXL2, lights of different luminance may be generated. In other words, when the same data signal (e.g., a data signal corresponding to a gray) is supplied to the first pixels PXL1 and the second pixels PXL2 as shown in FIG. 6, the voltage Vgs of the first driving transistor and the voltage Vgs of the second driving transistor are differently set, thus lights of different luminance may be generated from the first pixel PXL1 and second pixel PXL2.

When lights of different luminance corresponding to the same data signal are generated from the first pixel PXL1 and the second pixel PXL2, boundary portions of the first pixel area AA1 and the second pixel area AA2 are recognized by a user, thus display quality deteriorates. Accordingly, in the exemplary embodiment of the invention, by changing the luminance in the boundary portions of the first pixel area AA1 and the second pixel area AA2 in a gradation way, it is possible to prevent the boundary portions of the first pixel area AA1 and the second pixel area AA2 from being recognized by the user.

In FIG. 5 described above, although it has been described that the black data signal is supplied to the first pixels PXL1 and the white data signal is supplied to the second pixels PXL2, the invention is not limited thereto.

In an exemplary embodiment, when the display device is driven in the second mode, a data signal may not be supplied to the first pixels PXL1, for example. Even in this case, the first pixels PXL1 maintains a non-emissive state, thus a black screen is displayed in the first pixel area AA1. In addition, when the display device is driven in the second mode, the second pixels PXL2 receives data signals corresponding to various grays. Accordingly, the second pixels PXL2 display a predetermined image corresponding to a data signal.

That is, when a display device is driven in the second mode, the first pixels PXL1 are set to be in a non-emissive state, and the second pixels PXL2 are set to be in an emissive state corresponding to a data signal. In this case, the characteristic of the first driving transistor included in each of the first pixels PXL1 is different from that of the second driving transistor included in each of the second pixels PXL2, thus the luminance difference of the boundary portion therebetween may be recognized.

Figure 7:
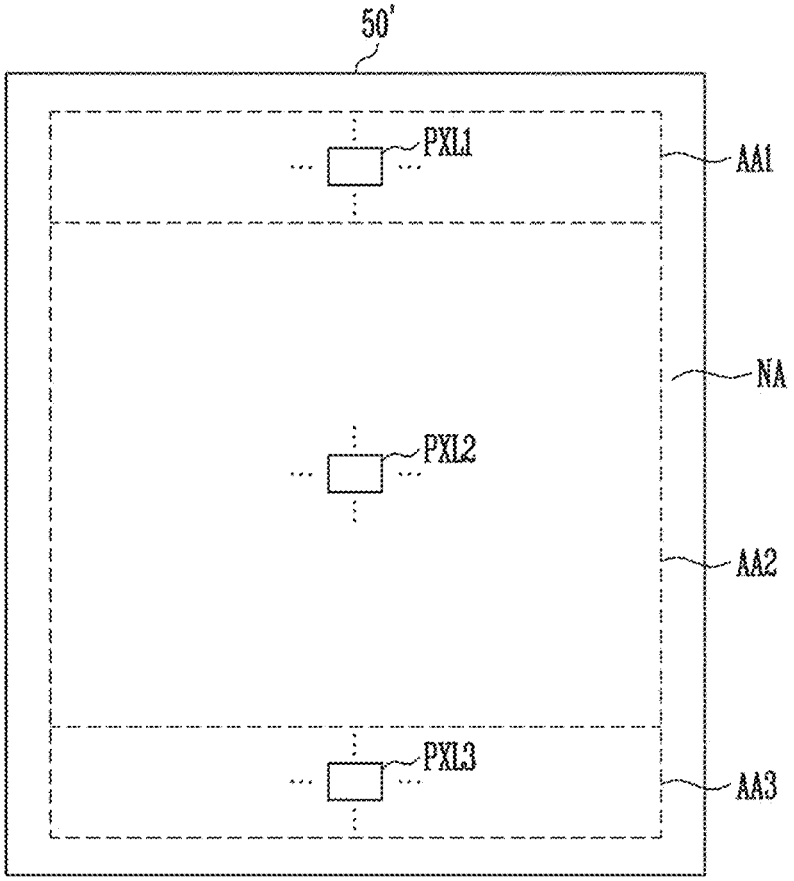
FIG. 7 illustrates another exemplary embodiment of a pixel area of a display device according to the invention.

FIG. 7 illustrates a pixel area of a display device according to another exemplary embodiment of the invention. In the description of FIG. 7, the same reference numerals designate the same constituent elements as those in FIG. 2, and a detailed description thereof will be omitted.

Referring to FIG. 7, a display device according to another exemplary embodiment of the invention includes pixel areas AA1, AA2, and AA3 and a peripheral area NA. In this case, the pixel areas AA1, AA2, and AA3 and the peripheral area NA may be provided on the substrate 50'.

A plurality of pixels PXL1, PXL2, and PXL3 are disposed in the pixel areas AA1, AA2, and AA3, respectively, thus a predetermined image is displayed in the pixel areas AA1, AA2, and AA3. Accordingly, the pixel areas AA1, AA2, and AA3 may be set as an effective display area.

Constituent elements (e.g., drivers and wires) for driving the pixels PXL1, PXL2, and PXL3 may be disposed in the peripheral area NA.

The pixel areas include the first pixel area AA1, the second pixel area AA2, and a third pixel area AA3.

The first pixel area AA1 may be positioned at one side (e.g., upper side) of the second pixel area AA2, and the third pixel area AA3 may be positioned at the other side (e.g., lower side) of the second pixel area AA2. That is, the second pixel area AA2 may be positioned between the first pixel area AA1 and the third pixel area AA3.

The third pixel area AA3 may be smaller than the second pixel area AA2. The third pixels PXL3 are provided in the third pixel area AA3. The third pixels PXL3 generate light of predetermined luminance corresponding to the data signals.

Each of the first pixels PXL1, the second pixels PXL2, and the third pixels PXL3 includes a driving transistor and an organic light emitting diode. The driving transistor controls a current amount supplied to the organic light emitting diode corresponding to a data signal.

Figure 8:
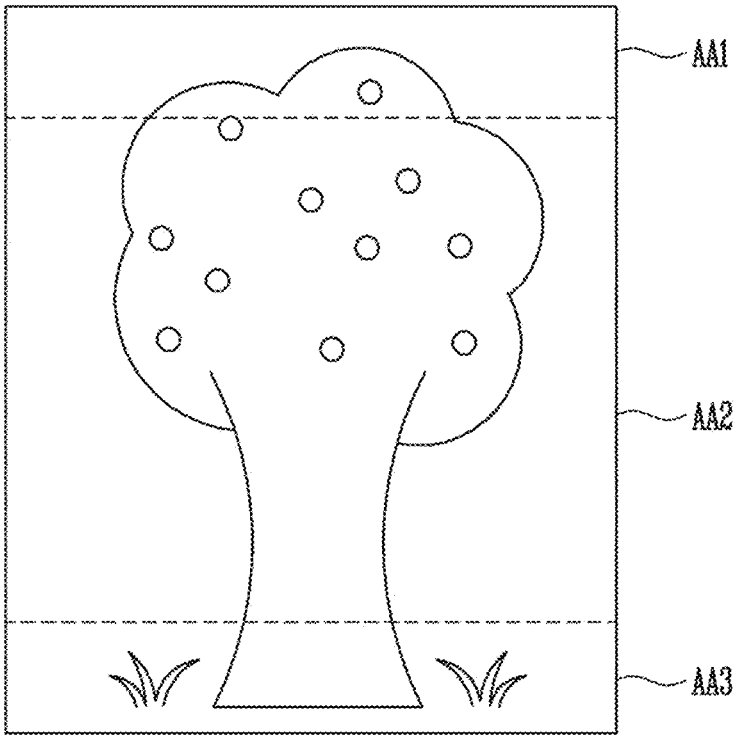
FIGS. 8 and 9 illustrate examples of an image displayed in the pixel area illustrated in FIG. 7 corresponding to a predetermined mode.

When the display device is driven in the first mode, as shown in FIG. 8, a predetermined image is displayed in the first pixel area AA1, the second pixel area AA2, and the third pixel area AA3.

Figure 9:
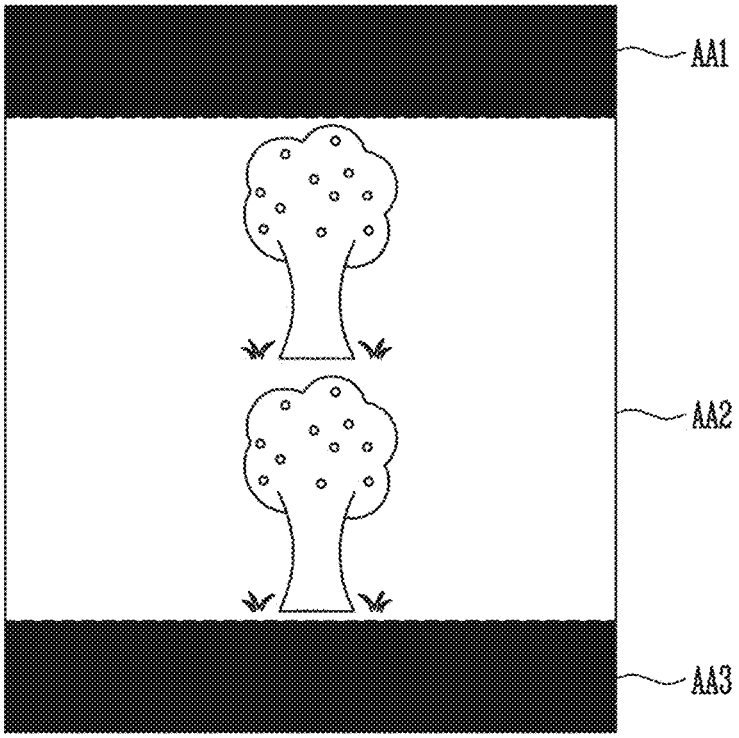

When a display device is driven in the second mode, as shown in FIG. 9, a predetermined image is displayed in the second pixel area AA2. In this case, the first pixels PXL1 included in the first pixel area AA1 and the third pixels PXL3 included in the third pixel area AA3 are set to be in a non-emissive state. In an exemplary embodiment, when the display device is driven in the second mode, a black screen may be displayed in the first pixel area AA1 and the third pixel area AA3, for example. In this case, the characteristics of respective driving transistors included in the first pixels PXL1, the second pixels PXL2, and the third pixels PXL3 are different from each other, thus a luminance difference may be recognized at boundary portions therebetween.

Accordingly, in the exemplary embodiment of the invention, by changing the luminance in the boundary portions of the first pixel area AA1 and the second pixel area AA2 and the third pixel area AA3 in a gradation way, it is possible to prevent the boundary portions of the first pixel area AA1, the second pixel area AA2, and the third pixel area AA3 from being recognized by the user.

Figure 10:
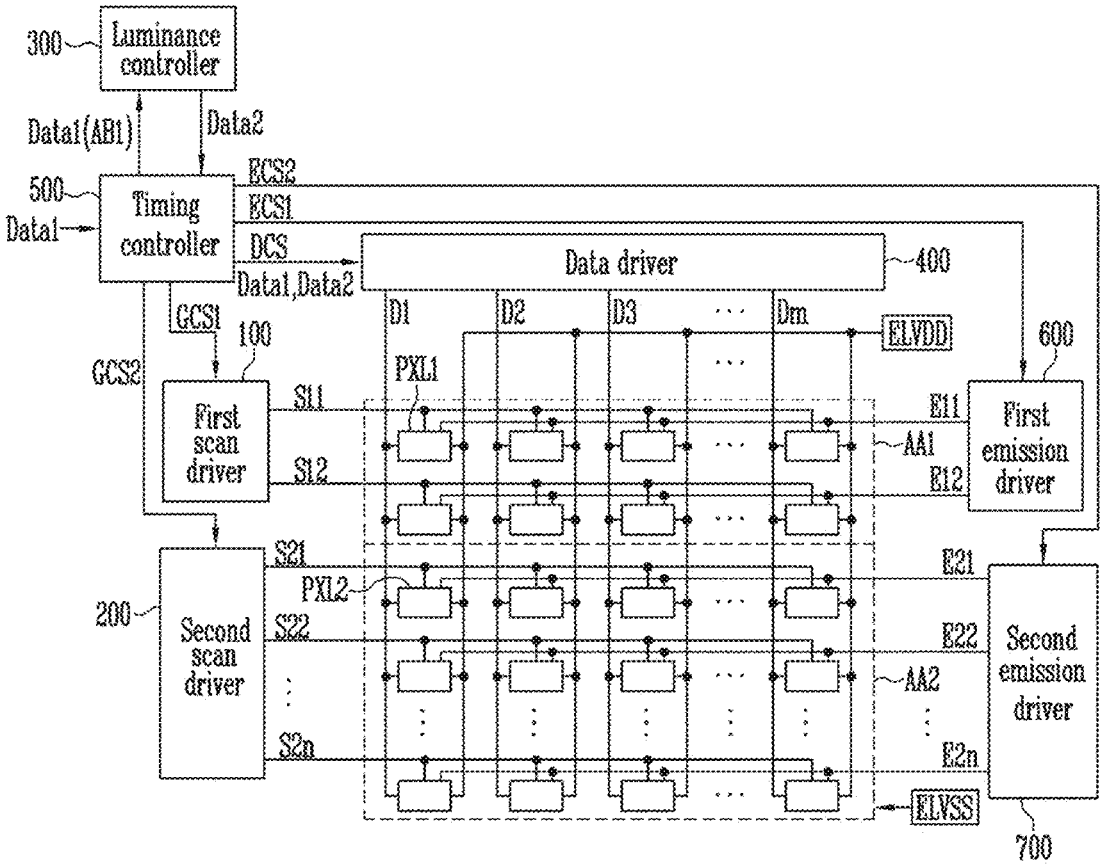
FIG. 10 illustrates a schematic view of an example of a display device corresponding to FIG. 2.

FIG. 10 illustrates a schematic view of an example of a display device corresponding to FIG. 2.

Referring to FIG. 10, a display device according to an exemplary embodiment of the invention includes a first scan driver 100, a second scan driver 200, a luminance controller 300, a data driver 400, a timing controller 500, a first emission driver 600, and a second emission driver 700.

A pixel area is divided into the first pixel area AA1 and the second pixel area AA2. The first pixel area AA1 includes the first pixels PXL1, and the second pixel area AA2 includes the second pixels PXL2.

The first pixels PXL1 is positioned to be connected to first scan lines S11 and S12, first light emitting control lines E11 and E12, and the data lines D1 to Dm. When a scan signal is supplied to the first scan lines S11 and S12, the first pixels PXL1 are selected to receive data signals from the data lines D1 to Dm. The first pixels PXL1 receiving the data signals generate light of predetermined luminance corresponding to the data signals. In this case, a light emitting time of the first pixels PXL1 is controlled by a light emitting control signal supplied from the first light emitting control lines E11 and E12.

The second pixels PXL2 are positioned to be connected to second scan lines S21 to S2*n*, the second light emitting control lines E21 to E2*n*, and the data lines D1 to Dm. When a scan signal is supplied to the second scan lines S21 to S2*n*, the second pixels PXL2 are selected to receive data signals from the data lines D1 to Dm. The second pixels PXL2 receiving the data signals generate light of predetermined luminance corresponding to the data signals. In this case, a light emitting time of the second pixels PXL2 is controlled by a light emitting control signal supplied from the second light emitting control lines E21 to E2*n*.

In FIG. 10, two first scan lines S11 and S12 and two first light emitting control lines E11 and E12 are illustrated in the first pixel area AA1, but the invention is not limited thereto. In exemplary embodiments, the first pixel area AA1 may include two or more of first scan lines S11 and S12 and two or more of first light emitting control lines E11 and E12, for example. In an exemplary embodiment, at least one dummy scan line and at least one dummy light emitting control line which are not illustrated may be further provided in the pixel areas AA1 and AA2 corresponding to circuit structures of the pixels PXL1 and PXL2.

The first scan driver 100 supplies a scan signal from the timing controller 500 to the first scan lines S11 and S12 corresponding to a first gate control signal GCS1. In an exemplary embodiment, the first scan driver 100 may sequentially supply the scan signal to the first scan lines S11 and S12, for example. When the scan signal is sequentially supplied to the first scan lines S11 and S12, the first pixels PXL1 are sequentially selected for each horizontal line. In this regard, the scan signal is set as a gate-on voltage so that a transistor included in the first pixels PXL1 may be turned on, for example.

When the display device is driven in the first mode, the first scan driver 100 may supply the scan signal to the first scan lines S11 and S12, and when the display device is driven in the second mode, the first scan driver 100 may not supply the scan signal to the first scan lines S11 and S12. When the scan signal is not supplied to the first scan lines S11 and S12, the first scan lines S11 and S12 are set to be in a gate-off voltage. Additionally, when the first scan driver 100 is driven in the second mode corresponding to a driving method, the scan signal may be supplied to the first scan lines S11 and S12.

The second scan driver 200 supplies a scan signal corresponding to a second gate control signal GCS2 from the timing controller 500 to the second scan lines S21 to S2*n*. In an exemplary embodiment, the second scan driver 200 may sequentially supply the scan signal to the second scan lines S21 to S2*n*. When the scan signal is sequentially supplied to the second scan lines S21 to S2*n*, the second pixels PXL2 are selected for each horizontal line. In this regard, the scan signal is set as a gate-on voltage so that a transistor included in the second pixels PXL2 may be turned on, for example.

When the display device is driven in the first mode and the second mode, the second scan driver 200 supplies the scan signal to the second scan lines S21 to S2*n*. Accordingly, the second pixels PXL2 display a predetermined image regardless of the modes of the display device (i.e., the first mode or the second mode).

The first emission driver 600 receives a first emission control signal ECS1 from the timing controller 500. The first emission driver 600 receiving the first emission control signal ECS1 supplies a light emitting control signal to the first light emitting control lines E11 and E12. In an exemplary embodiment, the first emission driver 600 may sequentially supply the light emitting control signal to the first light emitting control lines E11 and E12, for example. The light emitting control signal is used for controlling the light emitting time of the first pixel PXL1. In this regard, the light emitting control signal is set as a gate-off voltage so that a transistor included in the first pixel PXL1 may be turned off.

When the display device is driven in the first mode, the first emission driver 600 sequentially supplies the light emitting control signal to the first light emitting control lines E11 and E12. In addition, when the display device is driven in the second mode, the first emission driver 600 supplies the light emitting control signal to the first light emitting control lines E11 and E12 during a frame period. Accordingly, when the display device is driven in the second mode, the first light emitting control lines E11 and E12 are set to be in a gate-off voltage, thus the first pixels PXL1 is set to be in a non-emissive state. In this case, when the gate-off voltage is supplied to the first light emitting control lines E11 and E12, the first pixels PXL1 is set to be in a non-emissive state regardless of the scan signal supplied to the first scan lines S11 and S12.

The second emission driver 700 receives a second emission control signal ECS2 from the timing controller 500. The second emission driver 700 receiving the second emission control signal ECS2 supplies the light emitting control signal to the second light emitting control lines E21 to E2*n*. In an exemplary embodiment, the second emission driver 700 may sequentially supply the light emitting control signal to the second light emitting control lines E21 to E2*n*, for example. The light emitting control signal is used for controlling the light emitting time of the second pixel PXL2. In this regard, the light emitting control signal is set as a gate-off voltage so that a transistor included in the second pixel PXL2 may be turned off.

When the display device is driven in the first mode and a second mode, the second emission driver 700 sequentially supplies the light emitting control signal to the second light emitting control lines E21 to E2*n*. Accordingly, the second pixels PXL2 display a predetermined image regardless of the modes of the display device (i.e., the first mode or the second mode).

The data driver 400 receives a data control signal DCS, first data Data1, and second data Data2 from the timing controller 500. The data driver 400 generates data signals using the first data Data1 and the second data Data2, and supplies the data signals to the data lines D1 to Dm to be synchronized with the scan signals.

The timing controller 500 generates the first gate control signal GCS1, the second gate control signal GCS2, the first emission control signal ECS1, the second emission control signal ECS2, and the data control signal DCS based on timing signals supplied from the outside.

The first gate control signal GCS1 generated in the timing controller 500 is supplied to the first scan driver 100, and the second gate control signal GCS2 generated in the timing controller 500 is supplied to the second scan driver 200. In addition, the first emission control signal ECS1 and the second emission control signal ECS2 generated in the timing controller 500 are respectively supplied to the first emission driver 600 and the second emission driver 700. Further, the data control signal DCS generated in the timing controller 500 is supplied to the data driver 400.

Each of the first gate control signal GCS1 and the second gate control signal GCS2 includes a start signal and clock signals. The start signal controls timing at which the scan signals are supplied. The clock signals are used for shifting the start signal.

Each of the first emission control signal ECS1 and the second emission control signal ECS2 includes a light emitting start signal and clock signals. The light emitting start signal controls timing at which the light emitting control signal is supplied. The clock signals are used for shifting the light emitting start signal.

The data control signal DCS includes a source start signal, a source output enable signal, a source sampling clock, and the like. The source start signal controls a start point of data sampling of the data driver 400. The source sampling clock controls a sampling operation of the data driver 400 based on a rising or falling edge. The source output enable signal controls output timing of the data driver 400.

The luminance controller 300 receives the first data Data1(AB1) corresponding to a portion of one frame from the timing controller 500. In an exemplary embodiment, the luminance controller 300 may receive the first data Data1 (AB1) corresponding to a first boundary area AB1 shown in FIG. 11 from the timing controller 500, for example. Hereinafter, for better understanding and ease of description, the first data corresponding to the first boundary area AB1 are referred to as first boundary data Data1(AB1).

When the display device is driven in the first mode, the luminance controller 300 does not change a bit of the first boundary data Data1(AB1) supplied from the timing controller 500, and then outputs the first boundary data Data1 (AB1) as it is. That is, when the display device is driven in the first mode, the first boundary data Data1(AB1) inputted to the luminance controller 300 from the timing controller 500 and the second data Data2 supplied to the timing controller 500 from the luminance controller 300 respectively have the same gray level (i.e., the same bit).

When the display device is driven in the second mode, the luminance controller 300 controls (e.g., changes) the bit of the first boundary data Data1(AB1) supplied from the timing controller 500 to generate the second data Data2. In this case, when the bit of the first boundary data Data1(AB1) is changed, gray level (or luminance) of the first boundary data Data1(AB1) is changed. In an exemplary embodiment, the luminance controller 300 may control the bits of the second data Data2 so that luminance may be changed in a gradation way in the first boundary area AB1, for example.

The second data Data2 generated in the luminance controller 300 are supplied to the timing controller 500. The timing controller 500 supplies the first data Data1 and the second data Data2 supplied from the outside to the data driver 400. The data driver 400 generates data signals using the first data Data1 and the second data Data2, and supplies the generated data signals to the data lines D1 to Dm. Accordingly, when the display device is driven in the second mode, luminance is changed in a gradation way in the boundary portions of the first pixel area AA1 and the second pixel area AA2.

Additionally, in FIG. 10, it is illustrated that the luminance controller 300 is positioned outside the timing controller 500, but the invention is not limited thereto. In another exemplary embodiment, the luminance controller 300 may be positioned inside the timing controller 500, for example.

Figure 11:
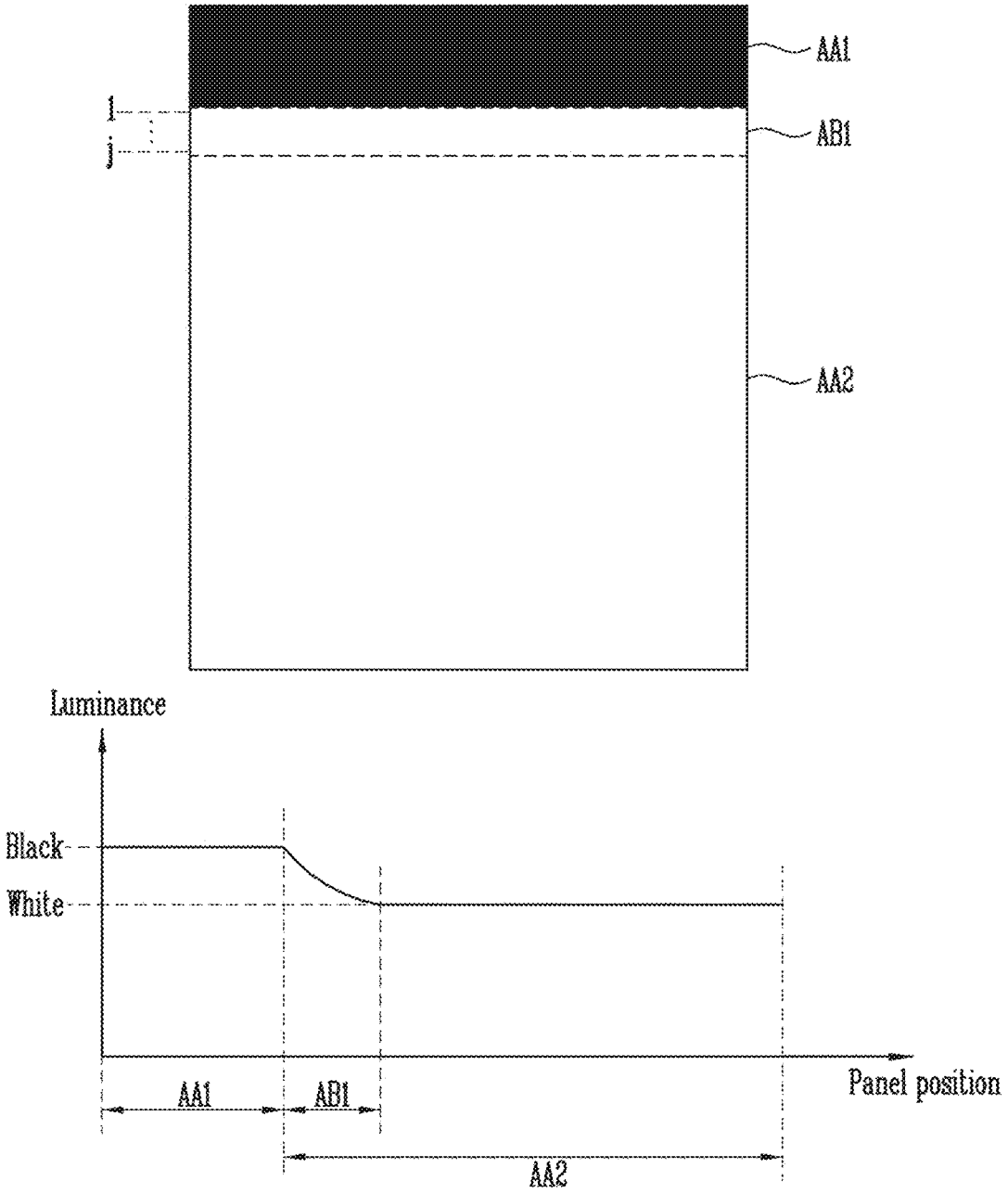
FIG. 11 illustrates an operation process of a luminance controller illustrated in FIG. 10 when a display device is driven in a second mode.

FIG. 11 illustrates an operation process of the luminance controller illustrated in FIG. 10 when the display device is driven in the second mode.

Referring to FIG. 11, the first boundary area AB1 is positioned between the first pixel area AA1 and the second pixel area AA2.

The first boundary area AB1 is set to include a plurality of horizontal lines. In an exemplary embodiment, when the number of the horizontal lines included in the first pixel area AA1 and the second pixel area AA2 is set as 100%, the first boundary area AB1 may be set to include the horizontal lines of 1% or more, for example. In an exemplary embodiment, an area of the first boundary area AB1 may be variously set corresponding to a resolution and a size of the panel.

The first boundary area AB1 is included in the second pixel area AA2, and when the same data signal is supplied thereto, the luminance thereof is changed in a gradation way. When the luminance of the first boundary area AB1 is changed in the gradation way, it is possible to prevent the boundary portions of the first pixel area AA1 and the second pixel area AA2 from being recognized by a user.

The timing controller 500 supplies the first boundary data Data1(AB1) corresponding to the first boundary area AB1 of the first data Data1 in one frame to the luminance controller 300. The luminance controller 300 receiving the first boundary data Data1(AB1) generates the second data Data2 through Equation 1:

$$\text{Data2}=\text{Data1}(AB1)\times\alpha \qquad \text{(Equation 1)}$$

In Equation 1, Data1(AB1) denotes first boundary data inputted from the timing controller 500, Data2 denotes the first boundary data generated in the luminance controller 300, and a denotes a luminance weight value. The luminance controller 300 generates the second data Data2 while changing the luminance weight value $\alpha$ corresponding to a position of the first boundary data Data1(AB1).

Herein, the luminance weight value $\alpha$ may be set so that luminance increases in a gradation way based on the boundary portions of the first pixel area AA1 and the second pixel area AA2. In an exemplary embodiment, the luminance weight value $\alpha$ may be set to be increased from 0% to 100% in a gradation way, for example.

When an operation process is described under an assumption in which j (where j is a natural number) horizontal lines are included in the first boundary area AB1, a luminance weight value α of a first horizontal line included in the first boundary area AB1 adjacent to boundary portions of the first pixel area AA1 and the second pixel area AA2 may be set to be 0%. In this case, the second data Data2 to be supplied to the first horizontal line included in the first boundary area AB1 is set so that luminance of 0%, that is, a black gray is realized through Equation 1.

In addition, a luminance weight value α of a predetermined horizontal line which is included in the first boundary area AB1 and corresponds to the middle of the first horizontal line and a j-th horizontal line may be set to be 50%. In this case, the second data Data2 to be supplied to the predetermined horizontal line included in the first boundary area AB1 is set to have luminance of 50% of an original gray through Equation 1.

Further, a luminance weight value α of the j-th horizontal line included in the first boundary area AB1 may be set as 100%. In this case, the second data Data2 to be supplied to the j-th horizontal line included in the first boundary area AB1 is set to have the luminance of the original gray through Equation 1. Thus, when the same data signal is supplied, the first boundary area AB1 is set so that the luminance thereof increases as farther from boundary portions of the first pixel area AA1 and the second pixel area AA2.

As described above, the luminance weight value α may linearly increase corresponding to a position of the first boundary area AB1. In an exemplary embodiment, the luminance weight value α may be set to linearly increase based on the boundary portions of the first pixel area AA1 and the second pixel area AA2, for example.

In addition, the luminance weight value α may nonlinearly increase corresponding to the position of the first boundary area AB1. In an exemplary embodiment, the luminance weight value α may be set to increase exponentially or logarithmically based on the boundary portions of the first pixel area AA1 and the second pixel area AA2, for example.

As described above, in the exemplary embodiment of the invention, when the same data signal is supplied, the luminance of the first boundary area AB1 is set to increase in a gradation way from the boundary portions of the first pixel area AA1 and the second pixel area AA2. Accordingly, it is possible to prevent the boundary portions of the first pixel area AA1 and the second pixel area AA2 from being recognized by a user. Additionally, the luminance weight value α may be pre-stored in a memory (not shown) included in the luminance controller 300.

Figure 12:
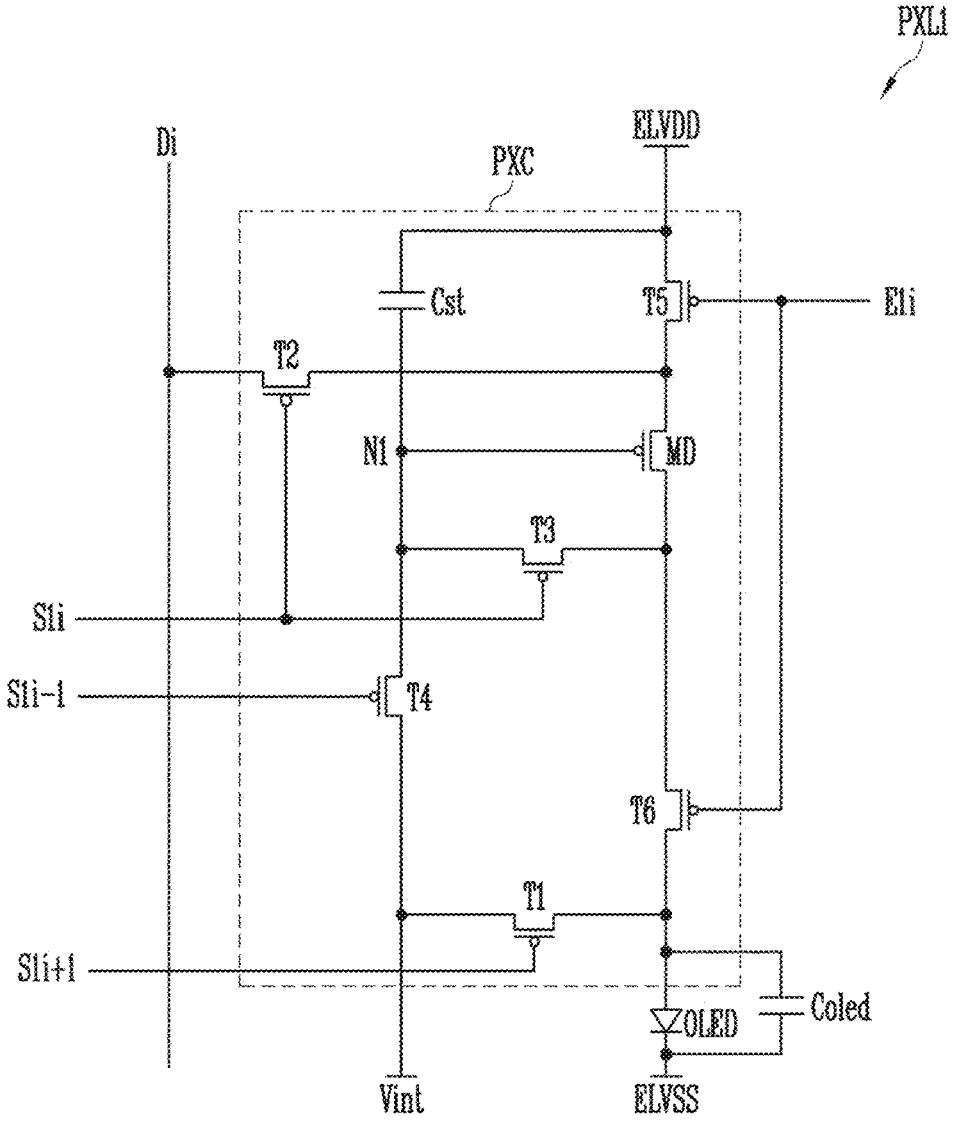
FIG. 12 illustrates an example of a first pixel illustrated in FIG. 10.

FIG. 12 illustrates an example of a first pixel illustrated in FIG. 10. For better understanding and ease of description, FIG. 12 illustrates a first pixel PXL1 which is connected with an i-th (i is a natural number) data Di and an i-th first scan line S1*i*.

Referring to FIG. 12, the first pixel PXL1 according to an exemplary embodiment of the invention includes an organic light emitting diode OLED and a pixel circuit PXC for controlling an amount of a current supplied to the organic light emitting diode OLED.

An anode electrode of the organic light emitting diode OLED is connected to the pixel circuit PXC, a cathode electrode thereof is connected to a second power supply ELVSS. The organic light emitting diode OLED generates light of predetermined luminance corresponding to an amount of a current supplied from the pixel circuit PXC. A first power supply ELVDD may be set to have a voltage higher than that of the second power supply ELVSS so that a current may be applied to the organic light emitting diode OLED.

The pixel circuit PXC includes a driving transistor MD and a first transistor T1 to a sixth transistor T6.

The first transistor T1 is connected between an initialization power source Vint and the anode electrode of the organic light emitting diode OLED. A gate electrode of the first transistor T1 is connected to an (i+1)-th first scan line S1*i*+1. When the scan signal is supplied to the (i+1)-th first scan line S1*i*+1, the first transistor T1 is turned on to supply a voltage of the initialization power source Vint to the anode electrode of the organic light emitting diode OLED.

When the initialization power source Vint is supplied to the anode electrode of the organic light emitting diode OLED, a parasitic capacitor of the organic light emitting diode OLED (hereinafter referred to as an "organic capacitor") is discharged. When the organic capacitor Coled is discharged, black-displaying capacity of the display device is improved.

Specifically, the organic capacitor Coled charges a predetermined voltage corresponding to the current supplied from the pixel circuit PXC during a previous frame period. When the organic capacitor Coled is charged, the organic light emitting diode OLED may easily light-emit even by a low current.

In a current frame period, a black data signal may be supplied to the pixel circuit PXC. When the black data signal is supplied, the pixel circuit PXC may not ideally supply a current to the organic light emitting diode OLED. However, even when the pixel circuit PXC including transistors receives the black data signal, it supplies a predetermined leakage current to the organic light emitting diode OLED. In this case, when the organic capacitor Coled is in a charged state, the organic light emitting diode OLED may weakly emit light, thus the black-displaying capacity deteriorates.

In contrast, as in the illustrated exemplary embodiment, when the initialization power source Vint is supplied, the organic capacitor Coled is discharged, thus even when a leakage current is supplied, the organic light emitting diode OLED is set to be in a non-emissive state. That is, in the illustrated exemplary embodiment, by supplying the initialization power source Vint to the anode electrode of the organic light emitting diode OLED, it is possible to improve the black-displaying capacity. The voltage of the initialization power source Vint is set to be lower than that of the data signal.

A first electrode of the driving transistor MD is connected to the first power supply ELVDD through a fifth transistor T5, and a second electrode thereof is connected to the anode electrode of the organic light emitting diode OLED through a sixth transistor T6. A gate electrode of the driving transistor MD is connected to a first node N1. The driving transistor MD controls an amount of a current applied to the second power supply ELVSS through the organic light emitting diode OLED from the first power supply ELVDD corresponding to a voltage of the first node N1.

A second transistor T2 is connected between a data line Di and the first electrode of the driving transistor MD. A gate electrode of the second transistor T2 is connected to the i-th first scan line S1*i*. When a scan signal is supplied to the i-th first scan line S1*i*, the second transistor T2 is turned on to electrically connect the data line Di and the first electrode of the driving transistor MD.

A third transistor T3 is connected between the second electrode of the driving transistor MD and the first node N1. A gate electrode of the third transistor T3 is connected to the i-th first scan line S1*i*. When a scan signal is supplied to the i-th first scan line S1*i*, the third transistor T3 is turned on to electrically connect the second electrode of the driving transistor MD and the first node N1. Accordingly, when the third transistor T3 is turned on, the driving transistor MD is diode-connected.

A fourth transistor T4 is connected between the first node N1 and the initialization power source Vint. The gate electrode of the fourth transistor T4 is connected to the (i−1)-th first scan line S1*i*-1. When a scan signal is supplied to the (i−1)-th first scan line S1*i*-1, the fourth transistor T4 is turned on to supply the voltage of the initialization power source Vint to the first node N1.

The fifth transistor T5 is connected between the first power supply ELVDD and the first electrode of the driving transistor MD. A gate electrode of the fifth transistor T5 is connected to an i-th first light emitting control line E1*i*. When a light emitting control signal is supplied to the i-th first light emitting control line E1*i*, the fifth transistor T5 is turned off, and otherwise, the fifth transistor T5 is turned on.

The sixth transistor T6 is connected between the second electrode of the driving transistor MD and the anode electrode of the organic light emitting diode OLED. A gate electrode of the sixth transistor T6 is connected to the i-th first light emitting control line E1*i*. When a light emitting control signal is supplied to the i-th first light emitting control line E1*i*, the sixth transistor T6 is turned off, and otherwise, the sixth transistor T6 is turned on.

A storage capacitor Cst is connected between the first power supply ELVDD and the first node N1. The storage capacitor Cst stores voltages corresponding to a data signal and a threshold voltage of the driving transistor MD.

Figure 13:
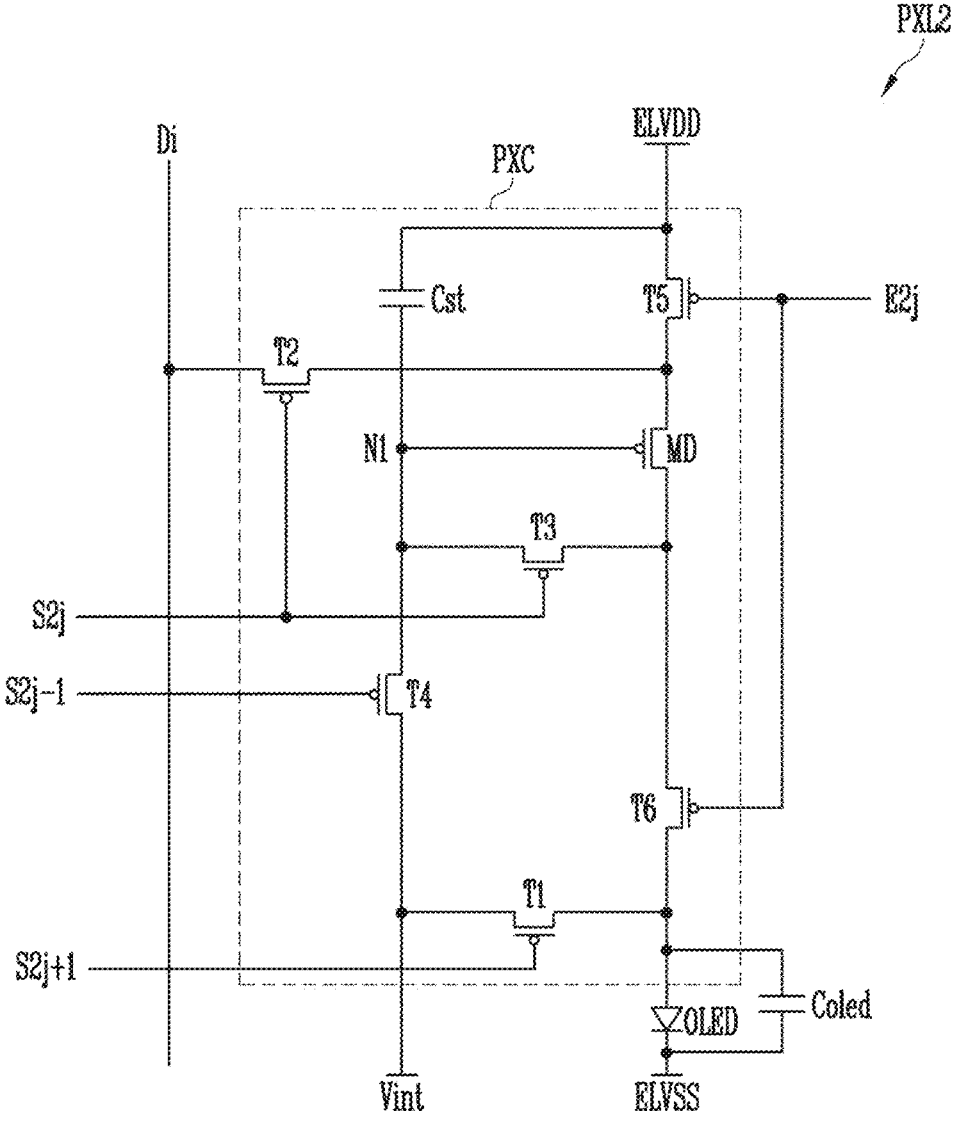
FIG. 13 illustrates an example of a second pixel illustrated in FIG. 10.

As shown in FIG. 13, the second pixel PXL2 has the same circuit structure as that of the first pixel PXL1. However, connection lines S2*j*, S2*j*−1, S2*j*+1 and E2*j* may be changed corresponding to a position at which the second pixel PXL2 is disposed.

Additionally, in the illustrated exemplary embodiment, the circuit structures of the pixels PXL1 and PXL2 are not limited to those of FIGS. 12 and 13. In the illustrated exemplary embodiment, the pixels PXL1 and PXL2 may be implemented by circuits having the known various structures, for example.

Figure 14:
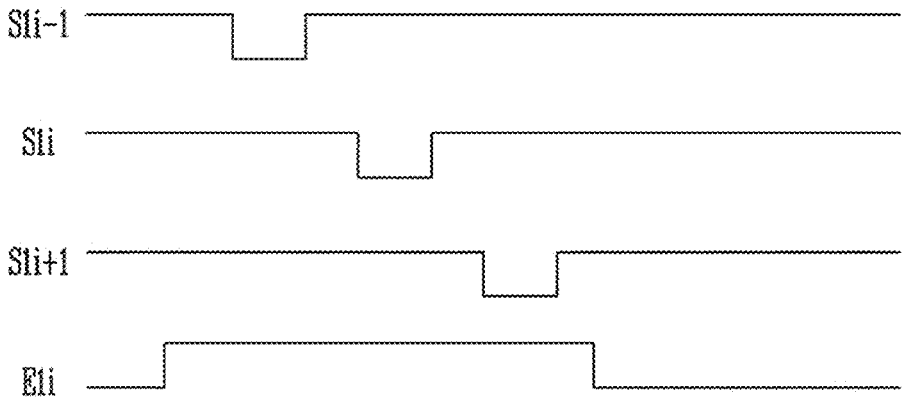
FIG. 14 illustrates a timing chart of when the first pixel illustrated in FIG. 12 is driven in a first mode.

FIG. 14 illustrates a timing chart of when the first pixel illustrated in FIG. 12 is driven in the first mode.

Referring to FIGS. 12 to 14, first, a light emitting control signal is supplied to the i-th first light emitting control line E1*i*. When the light emitting control signal is supplied to the i-th first light emitting control line E1*i*, the fifth transistor T5 and the sixth transistor T6 are turned off.

When the fifth transistor T5 is turned off, the first power supply ELVDD and the first electrode of the driving transistor MD are electrically disconnected. When the sixth transistor T6 is turned off, the second electrode of the driving transistor MD and the anode electrode of the organic light emitting diode OLED are is electrically disconnected. Accordingly, while the light emitting control signal is supplied to the i-th first light emitting control line E1*i*, the first pixel PXL1 is set to be in a non-emissive state.

After the light emitting control signal is supplied to the i-th first light emitting control line E1*i*, a scan signal is supplied to the (i−1)-th first scan line S1*i*-1. When the scan signal is supplied to the (i−1)-th first scan line S1*i*-1, the fourth transistor T4 is turned on. When the fourth transistor T4 is turned on, a voltage of the initialization power source Vint is supplied to the first node N1.

After the scan signal is supplied to the (i−1)-th first scan line S1*i*-1, the scan signal is supplied to the i-th first scan line S1*i*. When the scan signal is supplied to the i-th first scan line S1*i*, the second transistor T2 and the third transistor T3 are turned on.

When the third transistor T3 is turned on, the second electrode of the driving transistor MD and the first node N1 are electrically connected. That is, when the third transistor T3 is turned on, the driving transistor MD is diode-connected.

When the second transistor T2 is turned on, a data signal from the data line D1 is supplied to the first electrode of the driving transistor MD. In this case, since the first node N1 is set to have a voltage lower than that of data signal, the driving transistor MD is turned on. When the driving transistor MD is turned on, a voltage obtained by subtracting an absolute threshold voltage of the driving transistor MD from the voltage of the data signal is supplied to the first node N1. In this case, the storage capacitor Cst stores a voltage corresponding to the first node N1.

After the threshold voltage of the driving transistor MD and the voltage corresponding to the data signal are stored in the storage capacitor Cst, the scan signal is supplied to the (i+1)-th scan line S11+1. When the scan signal is supplied to the (i+1)-th scan line S1*i*+1, the first transistor T1 is turned on.

When the first transistor T1 is turned on, the voltage of the initialization power source Vint is supplied to the anode electrode of the organic light emitting diode OLED. Then, the organic capacitor Coled of organic light emitting diode OLED is discharged.

After the aforementioned procedure, the light emitting control signal is not supplied to the i-th first light emitting control line E1*i*. When the light emitting control signal is not supplied to the i-th first light emitting control line E1*i*, the fifth transistor T5 and the sixth transistor T6 are turned on. When the fifth transistor T5 is turned on, the first power supply ELVDD and the first electrode of the driving transistor MD are electrically connected. When the sixth transistor T6 is turned on, the second electrode of the driving transistor MD and the anode electrode of the organic light emitting diode OLED are electrically connected. In this case, the driving transistor MD controls an amount of a current flowing to the second power supply ELVSS via the organic light emitting diode OLED from the first power supply ELVDD corresponding to the voltage of the first node N1. Then, the organic light emitting diode OLED generates light of predetermined luminance corresponding to the amount of the current supplied from the driving transistor MD.

When the second pixel PXL2 is driven in the first mode or the second mode, it is driven in the same way as in the first pixel PXL1 described above, so a description thereof will be omitted. However, when the second pixel PXL2 is driven in the first mode or the second mode corresponding to the driving method described above, the second pixel PXL2 generates light of predetermined luminance.

A case in which the display device is driven in the second mode will be described as follows.

When the display device is driven in the second mode, a scan signal is not supplied to the first scan lines S1*i*-1 and S1*i*. When the scan signal is not supplied to the first scan lines S1*i*-1 and S1*i*, voltages of the first scan lines S1*i*-1 and S1*i* are set as a gate-off voltage. Accordingly, while the display device is driven in the second mode, the second transistor T2, the third transistor T3, and the first transistor T1 maintain turned off states.

While the display device is driven in the second mode, a light emitting control signal is supplied to the first light emitting control line E1*i*. That is, while the display device is driven in the second mode, a voltage of first light emitting control line E1*i* is set as a gate-off voltage. When the gate-off voltage is supplied to the first light emitting control line E1*i*, the fifth transistor T5 and the sixth transistor T6 are set to be in a turned off state. That is, while the display device is driven in the second mode, the first pixels PXL1 is set to be in a non-emissive state, thus a black screen may be displayed in the first pixel area AA1.

Figure 15:
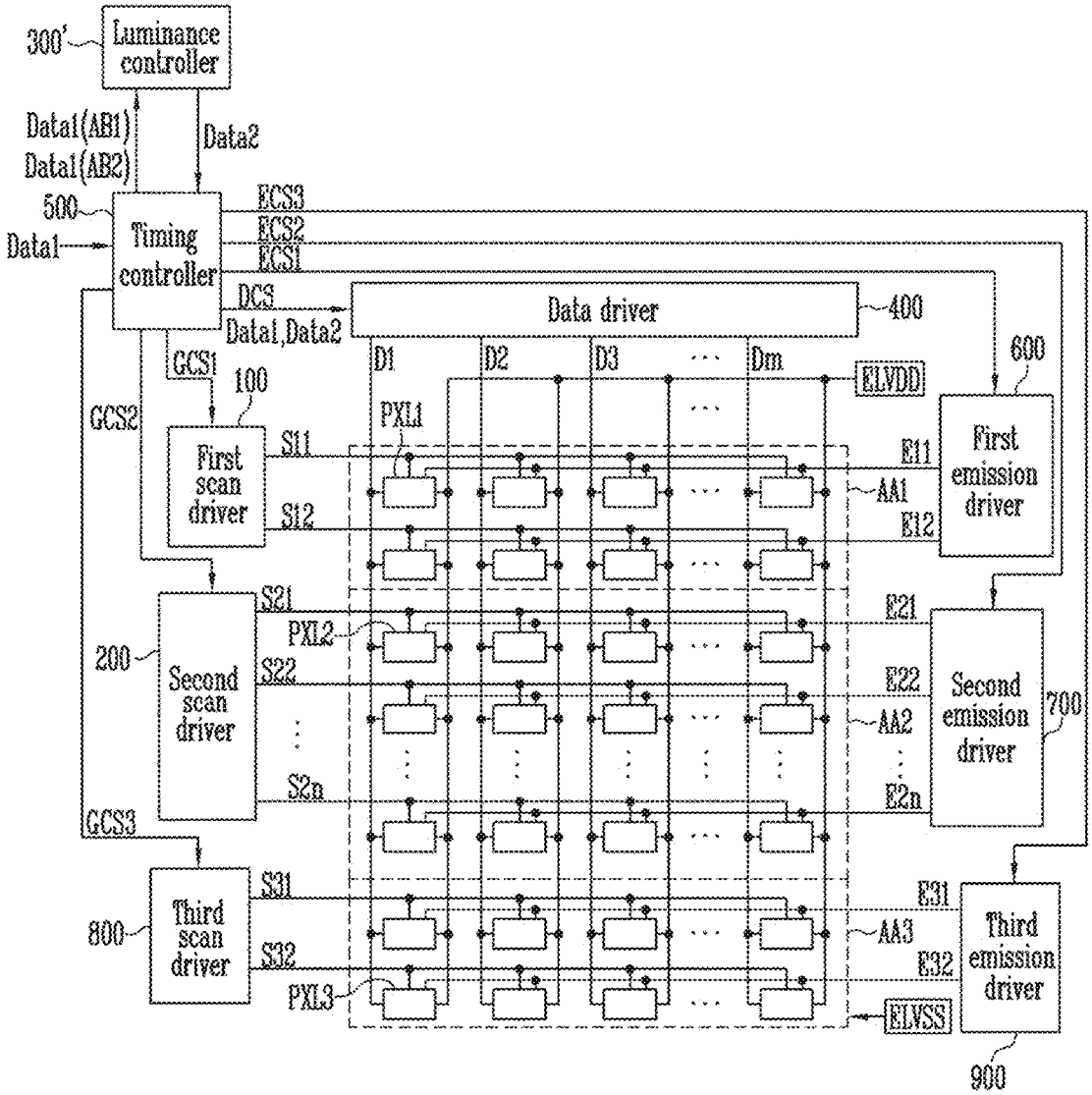
FIG. 15 illustrates an example of a display device corresponding to FIG. 7.

FIG. 15 illustrates an example of a display device corresponding to FIG. 7. In the description of FIG. 15, the same reference numerals designate the same constituent elements as those in FIG. 10, and a detailed description thereof will be omitted.

Referring to FIG. 15, a display device according to the exemplary embodiment of the invention includes the first scan driver 100, the second scan driver 200, a third scan driver 800, a luminance controller 300', the data driver 400, the timing controller 500, the first emission driver 600, the second emission driver 700, and a third emission driver 900.

A pixel area is divided into the first pixel area AA1, the second pixel area AA2, and the third pixel area AA3. The first pixel area AA1 includes the first pixels PXL1, and the second pixel area AA2 includes the second pixels PXL2. The third pixel area AA3 includes the third pixels PXL3.

The third pixels PXL3 is positioned to be connected to third scan lines S31 and S32, third control lines E31 and E32, and the data lines D1 to Dm. When a scan signal is supplied to the third scan lines S31 and S32, the third pixels PXL3 are selected to receive data signals from the data lines D1 to Dm. The third pixels PXL3 receiving the data signals generate light of predetermined luminance corresponding to the data signals. In this case, a light emitting time of the second pixels PXL3 is controlled by a light emitting control signal supplied from the third control lines E31 and E32.

In FIG. 15, two third scan lines S31 and S32 and two third light emitting control lines E31 and E32 are illustrated in the third pixel area AA3, but the invention is not limited thereto. In an exemplary embodiment, the third pixel area AA3 may be provided two or more of third scan lines S31 and S32 and two or more of third control lines E31 and E32, for example. In addition, at least one dummy scan line and at least one dummy light emitting control line which are not illustrated may be further provided in the third pixel area AA3 corresponding to a circuit structure of the third pixel PXL3.

The third scan driver 800 supplies a scan signal from the timing controller 500 to the third scan lines S31 and S32 corresponding to a third gate control signal GCS3. In an exemplary embodiment, the third scan driver 800 may sequentially supply the scan signal to the third scan lines S31 and S32. When the scan signal is sequentially supplied to the third scan lines S31 and S32, the third pixels PXL3 are sequentially selected for each horizontal line. In this regard, the scan signal is set as a gate-on voltage so that a transistor included in the third pixels PXL3 may be turned on, for example.

When the display device is driven in the first mode, the third scan driver 800 supplies the scan signal to the third scan lines S31 and S32, and when the display device is driven in the second mode, the third scan driver 800 may not supply the scan signal to the third scan lines S31 and S32. In this case, when the display device is driven in the second mode, the third scan lines S31 and S32 are set to be in a gate-off voltage.

The third emission driver 900 receives a third emission control signal ECS3 from the timing controller 500. The third emission driver 900 receiving the third emission control signal ECS3 supplies a light emitting control signal to the third control lines E31 and E32. In an exemplary embodiment, the third emission driver 900 may sequentially supply the light emitting control signal to the third control lines E31 and E32, for example. The light emitting control signal is used for controlling the light emitting time of the third pixel PXL3. In this regard, the light emitting control signal is set as a gate-off voltage so that a transistor included in the third pixel PXL3 may be turned off.

When the display device is driven in the first mode, the third emission driver 900 sequentially supplies the light emitting control signal to the third control lines E31 and E32. In addition, when the display device is driven in the second mode, the third emission driver 900 supplies the light emitting control signal to the third control lines E31 and E32 during a frame period. Accordingly, when the display device is driven in the second mode, the third control lines E31 and E32 are set to be in a gate-off voltage, thus the third pixels PXL3 is set to be in a non-emissive state.

The timing controller 500, based on the timing signals supplied from the outside, generates the first gate control signal GCS1, the second gate control signal GCS2, the third gate control signal GCS3, the first emission control signal ECS1, the second emission control signal ECS2, the third emission control signal ECS3, and the data control signal DCS.

The third gate control signal GCS3 generated in the timing controller 500 is supplied to the third scan driver 800, and the third emission control signal ECS3 is supplied to the third emission driver 900.

The third gate control signal GCS3 includes a start signal and clock signals. The start signal controls timing at which the scan signals are supplied. The clock signals are used for shifting the start signal.

The third emission control signal ECS3 includes a light emitting start signal and clock signals. The light emitting start signal controls timing at which the light emitting control signal is supplied. The clock signals are used for shifting the start signal.

The third pixel PXL3 has the same circuit structure as that of the first pixel PXL1 described above. Accordingly, the third pixel PXL3 is driven in the same manner as the first pixel PXL1, and a detailed description thereof will be omitted. Additionally, when the display device is driven in the first mode, the third pixel PXL3 displays a predetermined image, and when a display device is driven in the second mode, the third pixel PXL3 is set to be in a non-emissive state.

Figure 16:
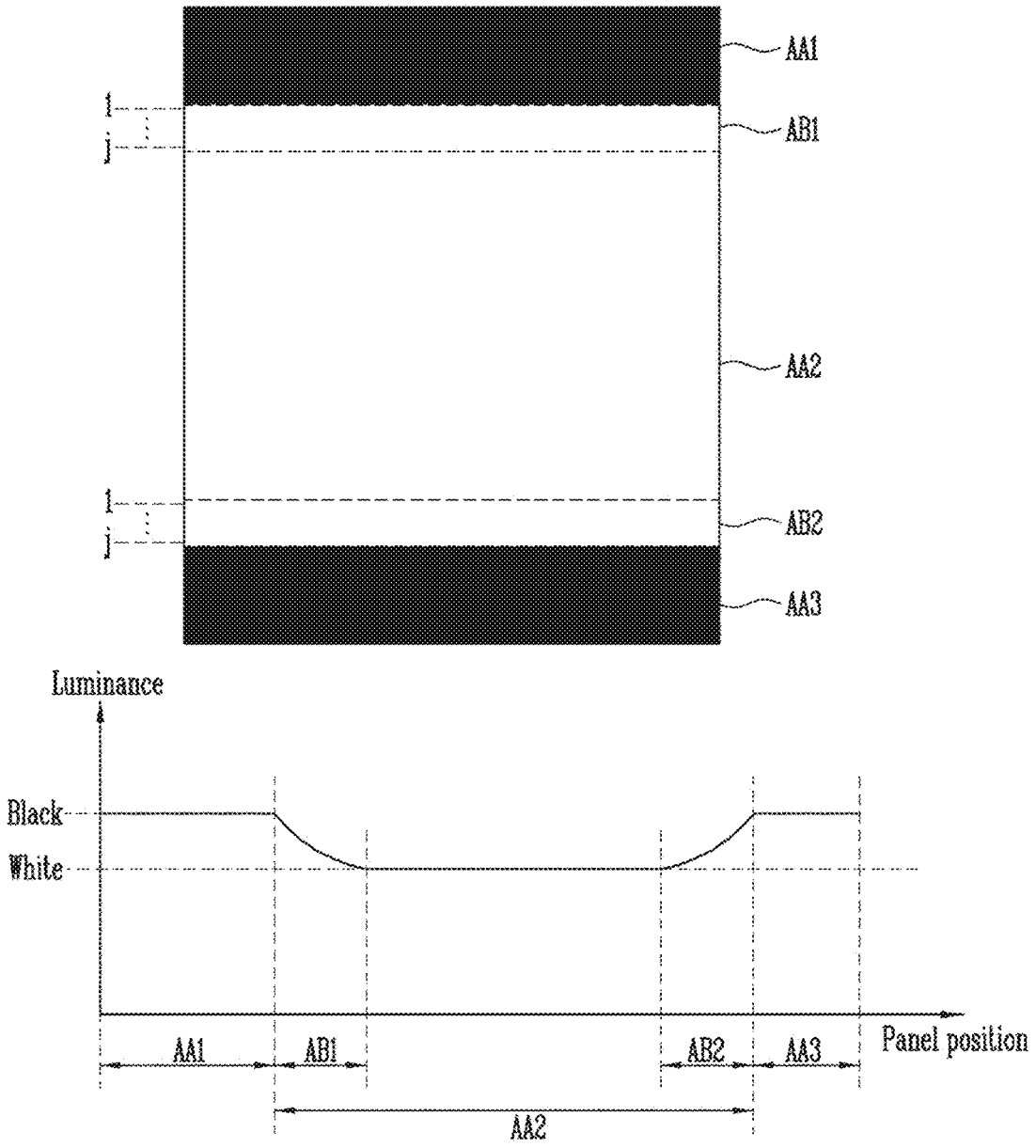
FIG. 16 illustrates an operation process of a luminance controller illustrated in FIG. 15 when a display device is driven in a second mode.

The luminance controller 300' receives the first data Data1(AB1) and Data1(AB2) corresponding to a portion of one frame from the timing controller 500. In an exemplary embodiment, the luminance controller 300', as shown in FIG. 16, may receive the first boundary data Data1(AB1) corresponding to the first boundary area AB1 and a second boundary data Data1(AB2) corresponding to a second boundary area AB2 from the timing controller 500, for example.

When the display device is driven in the first mode, the luminance controller 300' outputs the first boundary data Data1(AB1) and the second boundary data Data1(AB2) supplied from the timing controller 500 without changing bits of the first boundary data Data1(AB1) and the second boundary data Data1(AB2). That is, when the display device is driven in the first mode, the first boundary data Data1

(AB1) and the second boundary data Data1(AB2) inputted to the luminance controller 300' from the timing controller 500 and the second data Data2 supplied to the timing controller 500 from the luminance controller 300 have the same gray level (the same bit).

When the display device is driven in the second mode, the luminance controller 300' controls bits of the first boundary data Data1(AB1) and the second boundary data Data1(AB2) supplied from the timing controller 500 to generate the second data Data2. In this case, when the bits of the first boundary data Data1(AB1) and the second boundary data Data1(AB2) are changed, the gray level (or luminance) is changed. In an exemplary embodiment, the luminance controller 300' may generate the second data Data2 so that the luminance may be changed in a gradation way in the first boundary area AB1 and the second boundary area AB2, for example.

The second data Data2 generated in the luminance controller 300' is supplied to the timing controller 500. The timing controller 500 supplies the first data Data1 and the second data Data2 supplied from the outside to the data driver 400. The data driver 400 generates a data signal using the first data Data1 and the second data Data2, and supplies the generated data signal to the data lines D1 to Dm. Accordingly, when display device is driven in the second mode, the luminance is changed in a gradation way in the first boundary area AB1 and the second boundary area AB2, thus it is possible to prevent a luminance difference at the boundary portion from being recognized by a user.

Additionally, FIG. 15 illustrates the case in which the luminance controller 300' is positioned outside the timing controller 500, but the invention is not limited thereto. In another exemplary embodiment, the luminance controller 300' may be positioned inside the timing controller 500, for example.

FIG. 16 illustrates an operation process of the luminance controller illustrated in FIG. 15 when the display device is driven in the second mode.

Referring to FIG. 16, the first boundary area AB1 is positioned between the first pixel area AA1 and the second pixel area AA2, and the second boundary area AB2 is positioned between the second pixel area AA2 and the third pixel area AA3.

The first boundary area AB1 and the second boundary area AB2 are set to include a plurality of horizontal lines. In an exemplary embodiment, when the number of the horizontal lines included in the first pixel area AA1, the second pixel area AA2, and the third pixel area AA3 is set as 100%, an area of each of the first boundary area AB1 and the second boundary area AB2 is set to includes the horizontal lines of 1% or more, for example. In fact, the areas of the first boundary area AB1 and the second boundary area AB2 may be variously set corresponding to a resolution and a size of the panel.

The first boundary area AB1 and the second boundary area AB2 are included in the second pixel area AA2, and when the same data signal is supplied thereto, each luminance thereof is changed in a gradation way. As such, when each luminance of the first boundary area AB1 and the second boundary area AB2 is changed in the gradation way, it is possible to prevent the boundary portions of the first pixel area AA1 and the second pixel area AA2 and the boundary portions of the second pixel area AA2 and the third pixel area AA3 from being recognized by a user.

The timing controller 500 supplies the first boundary data Data1(AB1) corresponding to the first boundary area AB1 of the first data Data1 of one frame to the luminance controller 300'. In addition, the timing controller 500 supplies the second boundary data Data1 (AB2) corresponding to the second boundary area AB2 of the first data Data1 of one frame to the luminance controller 300'. The luminance controller 300' receiving the first boundary data Data1(AB1) generates the second data Data2 through Equation 1. In addition, the luminance controller 300' receiving the second boundary data Data1(AB2) generates the second data Data2 through Equation 2:

$$\text{Data2}=\text{Data1}(AB2)\times\alpha \qquad \text{(Equation 2)}$$

In Equation 2, Data1(AB2) denotes a second boundary data inputted from the timing controller 500, Data2 denotes a second boundary data generated in the luminance controller 300', and $\alpha$ denotes a luminance weight value. The luminance controller 300' generates the second data Data2 while changing the luminance weight value $\alpha$ corresponding to the position of the second boundary data Data1 (AB2).

Herein, the luminance weight value $\alpha$ may be set so that luminance increases in a gradation way based on the boundary portions of the second pixel area AA2 and the third pixel area AA3.

When an operation process is described under an assumption in which j (j is a natural number) horizontal lines are included in the second boundary area AB2, a luminance weight value $\alpha$ of the j-th horizontal line included in the second boundary area AB2 adjacent to boundary portions of the second pixel area AA2 and the third pixel area AA3 may be set to be 0%. In this case, the second data Data2 to be supplied to the j-th horizontal line included in the first boundary area AB1 is set so that luminance of 0%, that is, a black gray is realized through Equation 2.

In addition, a luminance weight value $\alpha$ of a predetermined horizontal line which is included in the second boundary area AB2 and corresponds to the middle of the first horizontal line and the j-th horizontal line may be set to be 50%. In this case, the second data Data2 to be supplied to the predetermined horizontal line included in the second boundary area AB2 is set to have luminance of 50% of an original gray through Equation 2.

Further, a luminance weight value $\alpha$ of the first horizontal line included in the second boundary area AB2 may be set as 100%. In this case, the second data Data2 to be supplied to the first horizontal line included in the second boundary area AB2 is set to have the luminance of the original gray through Equation 2. Thus, when the same data signal is supplied, the second boundary area AB2 is set so that the luminance thereof increases as farther from boundary portions of the second pixel area AA2 and the third pixel area AA3.

As described above, the luminance weight value $\alpha$ may linearly increase corresponding to a position of the second boundary area AB2. In an exemplary embodiment, the luminance weight value $\alpha$ may be set to linearly increase based on the boundary portions of the second pixel area AA2 and the third pixel area AA3, for example.

In addition, the luminance weight value $\alpha$ may nonlinearly increase corresponding to the position of the second boundary area AB2. In an exemplary embodiment, the luminance weight value $\alpha$ may be set to increase exponentially or logarithmically based on the boundary portions of the second pixel area AA2 and the third pixel area AA3, for example.

As described above, in the illustrated exemplary embodiment, when the same data signal is supplied, each luminance of the first boundary area AB1 and the second boundary area AB2 is set to be changed in a gradation way. Accordingly, it is possible to prevent the boundary portions of the first pixel area AA1 and the second pixel area AA2 and the boundary portions of the second pixel area AA2 and the third pixel area AA3 from being recognized by a user.

Additionally, in the exemplary embodiments described above, it is described that the luminance controllers 300 and 300' control the luminance of the boundary areas AB1 and AB2 through Equation 1 and Equation 2, but the invention is not limited thereto. In an exemplary embodiment, the luminance controller 300 and 300' may control the luminance of the boundary areas AB1 and AB2 through Equation 3:

$$\text{Data}2=\text{Data}1(AB1 \text{ or } AB2)\times\alpha+\beta \quad \text{(Equation 3)}$$

In Equation 3, Data1(AB1) denotes first boundary data inputted from the timing controller 500, Data1(AB2) denotes second boundary data inputted from the timing controller 500, Data2 denotes first boundary data or second boundary data generated in the luminance controllers 300 and 300', $\alpha$ denotes a luminance weight value, and $\beta$ denotes an initial gray level.

Herein, $\beta$ is set as a predetermined gray level, for example, as a gray level of one of other gray levels excluding a black gray. In other words, when the display device implements 255 grays, $\beta$ is set to have a gray level excluding a gray of 0 (e.g., black gray).

When the luminance controllers 300 and 300' generate the second data Data2 through Equation 3, each luminance of the boundary areas AB1 and AB2 is set to increase in a gradation way from a gray level (i.e., a gray of (3) exceeding the black gray.

Since the exemplary embodiments according to the concept of the invention may have various modifications and various forms, the exemplary embodiments will be illustrated in the drawings and be fully described in the specification. However, it is to be understood that the exemplary embodiments according to the concept of the invention are not limited the specific forms of invention but include all modifications, equivalents, and substitutions included in the spirit and scope of the invention. While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device driven in one of a first mode and a second mode, the display device comprising:

a first pixel area which includes first pixels;

a second pixel area which includes second pixels;

a first boundary area which is included in the second pixel area and positioned adjacent to the first pixel area, the first boundary area including a first side between the first pixel area and the second pixel area and a first opposite side opposite to the first side;

a first scan driver which drives first scan lines connected to the first pixels; and a second scan driver which drives second scan lines connected to the second pixels, wherein, in the first mode:

the first scan driver supplies first scan signals to the first scan lines;

the second scan driver supplies second scan signals to the second scan lines; and the first boundary area displays an image with luminance maintained as farther from the first side to the first opposite side, and wherein, in the second mode:

the first scan driver supplies a gate-off voltage to the first scan lines;

the second scan driver supplies the second scan signals to the second scan lines; and the first boundary area displays an image with luminance gradually increasing as farther from the first side to the first opposite side.

2. The display device of claim 1, wherein:

at least one of the first pixels and at least one of the second pixels are connected to a same data line.

3. The display device of claim 1, wherein:

when the display device is disposed on a wearable device, the display device is set to be driven in the second mode; and otherwise, the display device is set to be driven in the first mode.

4. The display device of claim 1, wherein:

when all of horizontal lines included in the first pixel area and the second pixel area are set as about 100%, the first boundary area is set to include horizontal lines of about 1% or more.

5. The display device of claim 1, wherein, in the first mode:

the first pixels are set to be in an emissive state; and the second pixels are set to be in an emissive state, and wherein, in the second mode:

the first pixels are set to be in a non-emissive state; and the second pixels are set to be in an emissive state.

6. The display device of claim 1, further comprising:

a first emission driver which drives first light emitting control lines connected to the first pixels; and a second emission driver which drives second light emitting control lines connected to the second pixels.

7. The display device of claim 6, wherein, in the first mode:

the first emission driver supplies first light emitting control signals to the first light emitting control lines; and the second emission driver supplies second light emitting control signals to the second light emitting control lines, and wherein, in the second mode:

the first emission driver supplies the gate-off voltage to the first light emitting control lines; and the second emission driver supplies the second light emitting control signals to the second light emitting control lines.

8. The display device of claim 7, further comprising:

a third pixel area which includes third pixels;

a second boundary area which is included in the second pixel area and positioned adjacent to the third pixel area, the second boundary area including a second side between the third pixel area and the second pixel area and a second opposite side opposite to the second side; and a third scan driver which drives third scan lines connected to the third pixels, wherein, in the first mode:

the third scan driver supplies third scan signals to the third scan lines; and the second boundary area displays an image with luminance maintained as farther from the second side to the second opposite side, and wherein, in the second mode:

the third scan driver supplies the gate-off voltage to the third scan lines; and the second boundary area displays an image with luminance gradually changing as farther from the second side to the second opposite side.

9. The display device of claim 8, further comprising:

a third emission driver which drives third light emitting control lines connected to the third pixels.

10. The display device of claim 9, wherein, in the first mode:

the third emission driver supplies third light emitting control signals to the third light emitting control lines, and wherein, in the second mode:

the third emission driver supplies the gate-off voltage to the third light emitting control lines.

11. The display device of claim 10, wherein:

at least one of the first pixels, at least one of the second pixels, and at least one of the third pixels are connected to a same data line.

12. The display device of claim 10, wherein, in the first mode:

the first pixels are set to be in an emissive state;

the second pixels are set to be in an emissive state; and the third pixels are set to be in an emissive state, and wherein, in the second mode:

the first pixels are set to be in a non-emissive state;

the second pixels are set to be in an emissive state; and the third pixels are set to be in a non-emissive state.

* * * * *